US005857137A

United States Patent [19]

Sakata et al.

[11] Patent Number: 5,857,137

[45] Date of Patent: Jan. 5, 1999

[54] IMAGE FORMING APPARATUS AND METHOD COMPRISING REFEEDING UNIT WITH PRIORITY REFEEDING

[75] Inventors: Toshio Sakata, Toyohashi; Masayoshi Kuroda, Toyokawa; Taiichi Oominami, Chiryu; Tomonobu Tamura, Toyokawa, all of Japan

[73] Assignee: Minolta Co., Ltd., Osaka, Japan

[21] Appl. No.: 412,974

[22] Filed: Mar. 29, 1995

[30] Foreign Application Priority Data

Mar. 31, 1994 [JP] Japan ..... 6-063550

[51] Int. Cl.[6] ..... G03G 15/00; G03G 21/00; B65H 5/22

[52] U.S. Cl. ..... 399/402; 271/3.03

[58] Field of Search ..... 355/24, 311, 319; 271/3.03, 65, 123, 301; 399/388, 401, 402

[56] References Cited

U.S. PATENT DOCUMENTS

| | | | |
|---|---|---|---|
| 4,548,403 | 10/1985 | Matsui et al. | 271/296 |
| 4,585,336 | 4/1986 | Tanaka | 355/24 X |
| 4,866,472 | 9/1989 | Yamakoshi et al. | 355/27 |
| 4,975,738 | 12/1990 | Senma et al. | 355/319 X |
| 5,010,363 | 4/1991 | Hagashio et al. | 399/19 |
| 5,026,036 | 6/1991 | Takahashi | 271/3.03 |
| 5,084,741 | 1/1992 | Takemura et al. | 356/316 |
| 5,087,026 | 2/1992 | Wyer | 271/3.03 X |
| 5,110,104 | 5/1992 | Wakao et al. | 271/3.03 |
| 5,132,720 | 7/1992 | Kioka et al. | 355/24 |
| 5,150,168 | 9/1992 | Kamath et al. | 355/319 |
| 5,166,740 | 11/1992 | Tanahashi et al. | 355/321 |
| 5,216,474 | 6/1993 | Nakao | 355/319 |
| 5,221,951 | 6/1993 | Sakamoto | 355/311 |
| 5,233,401 | 8/1993 | Sasaki et al. | 355/319 |
| 5,485,261 | 1/1996 | Kuroda et al. | 355/319 |

*Primary Examiner*—Fred L. Braun
*Attorney, Agent, or Firm*—Sidley & Austin

[57] ABSTRACT

A copying machine which has a function to contain sheets, each of which has an image on a first side, in a refeeding unit and refeed the sheets for forming an image on a second side. The refeeding unit has an intermediate tray, a pick-up roller for refeeding the sheets one by one and a containing section for feeding the sheets to the intermediate tray. Each of the sheets is fed into the intermediate tray by a first or a second roller of the containing section. The containing section is movable along a transporting way and set at such a position that the first and the second roller are positioned corresponding to the size of sheets to be contained in the intermediate tray.

23 Claims, 24 Drawing Sheets

IMAGE FORMING APPARATUS AND METHOD COMPRISING REFEEDING UNIT WITH PRIORITY REFEEDING

BACKGROUND OF THE INVENTION

1. Field of the Invention

The present invention relates to an image forming apparatus, and more particularly to an image forming apparatus which has a refeeding device which contains a first-imaged sheet (a sheet which has a formed image on a first side) and refeeds the sheet to an image recording section for duplex copying or composite copying in an electrophotographic copy machine, a laser printer or an ink jet printer.

2. Description of Related Art

Recently, in copy machines, in order to carry out duplex copying wherein images are formed on a front and a back side of a sheet and a composite copying wherein images are formed overlaid on the same side of the sheet, various refeeding devices for piling up first-imaged sheets in an intermediate tray and refeeding the sheets to an image transferring position have been developed.

In this kind of refeeding devices, usually, a first-imaged sheet is sent by a containing roller into an intermediate tray. In order to contain sheets regulated on the intermediate tray, the containing roller needs to be set corresponding to a trailing edge of a contained sheet. If two or three sizes of sheets are used, the sheets are regulated by setting a plurality of containing rollers corresponding to each size of the sheets and providing diverters which switch a sheet transporting way to the corresponding roller. However, the sheet size is diverse. Since several kinds of A size and B size are used in Japan and several inch sizes are used in the United States and in Europe, it is impossible to accommodate all of these sizes.

SUMMARY OF THE INVENTION

An object of the present invention is to provide an image forming apparatus which can contain various sizes of sheets regulated on an intermediate tray in a compact structure.

Another object of the present invention is to provide an image forming apparatus which can transport a sheet into an intermediate tray surely and smoothly.

Another object of the present invention is to provide an image forming apparatus wherein releasing a stuck sheet and the maintenance is easy.

Another object of the present invention is to provide an image forming apparatus which can refeed a plurality of recording sheets efficiently and surely.

In order to attain the objects, an image forming apparatus according to the present invention comprises an intermediate tray, a containing section for sending first-imaged sheets into the intermediate tray and a pick-up roller for feeding the sheets which are contained in the intermediate tray one by one. The feeding section is movable along the intermediate tray to a position which corresponds to the size of the sheets.

In the above structure, the containing section is moved to a position which is near the trailing edge of the sheets to be contained in the intermediate tray and sends the sheets into the intermediate tray. Therefore, though the sheet size is various, containing rollers and diverters for the respective sheet sizes are unnecessary. If one or two rollers are arranged in a sheet transporting direction, these rollers can handle almost all sizes of sheets.

Further, the image forming apparatus according to the present invention comprises a flexible sheet guiding member wherein one end of the sheet guiding member is fixed to the containing section and extends upstream with respect to the sheet transporting direction, and a member which is connected with the other end of the guiding member and tensions the guiding member at all times. The guiding member is substantially kept horizontal and guides the sheet.

Further, in the image forming apparatus according to the present invention, the containing section has a lower driving roller and an upper driven roller which send the sheets into the intermediate tray. A holding member which holds the upper driven roller rotatable is movable on an upper guiding plate in the sheet transporting direction. The upper guiding plate can be opened upward. The upper driven roller moves upward when the upper guiding plate is opened, and a sheet transporting way in the containing section is opened accordingly. Thereby, the removal of a jammed sheet and the maintenance become easy.

Further, the image forming apparatus according to the present invention comprises a controller which, when a sheet is sent into the intermediate tray after a specified number of sheets are piled/contained in the intermediate tray, the specified number being determined from a set number of imaged sheets to be made, feeds the sheet prior to the piled/contained sheets, and a pressing member which, immediately after the specified number of sheets are piled/contained in the intermediate tray, starts pressing a trailing portion of the sheets.

For example, in the image forming apparatus wherein when a first-imaged sheet comes to the intermediate tray, the following three sheets have already received the first image, in carrying out duplex or composite copying of ten sheets, the seventh, the eighth, the ninth and the tenth first-imaged sheets are refed from the intermediate tray prior to the first six sheets contained in the intermediate tray (priority refeeding). Although in the priority refeeding, the sheets are sent sliding on the contained sheets, since the contained sheets are pressed by the pressing member, the contained sheets are not drawn by the refed sheets.

BRIEF DESCRIPTION OF THE DRAWING

These and other objects and features of the present invention will become apparent from the following description with reference to the accompanying drawings, in which.

DETAILED DESCRIPTION OF THE PREFERRED EMBODIMENTS

The description of preferred embodiments according to the present invention is given below, referring to the accompanying drawings. In an embodiment which is explained below, the present invention is applied to an electrophotographic copy machine.

[General Structure of Copy Machine]

Figure 1:
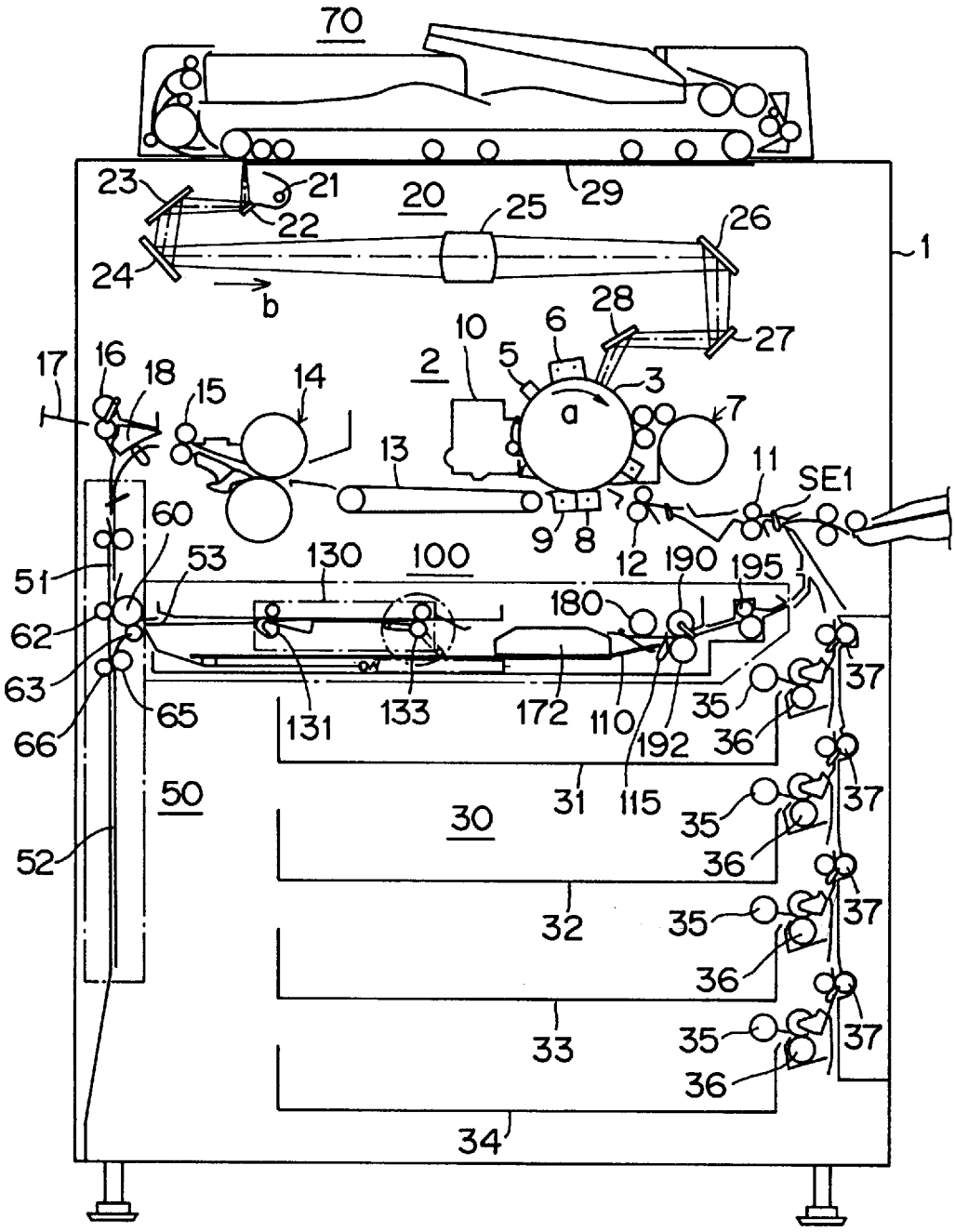
FIG. 1 is an internal elevational view of a copy machine which is an embodiment of the present invention.

In FIG. 1, a copy machine is provided with an image forming section 2 at an intermediate section of a body 1, an optical system 20 for exposure at an upper section, a feeding section 30 at a lower section, a refeeding unit 100 between the image forming section 2 and the feeding section 30 and a sheet reversing unit 50 at an upstream of the refeeding unit 100. An automatic document feeder (ADF) 70 is provided on the body 1. Also, since a structure of the ADF 70 is well-known, the description of the ADF 70 is omitted.

The image forming section 2 is mainly composed of a photosensitive drum 3 which is rotatable in a direction indicated with arrow a. A residual charge eraser 5, a charger 6, a developing device 7, a transfer charger 8, a sheet separating charger 9 and a residual toner cleaner 10 are provided around the photosensitive drum 3 in a rotating direction. Also, since the structure of these image forming elements and the image forming process are well-known, the description about them is omitted.

The optical system 20 is composed of an exposure lamp 21, movable mirrors 22, 23 and 24, an image forming lens 25 and fixed mirrors 26, 27 and 28. The lamp 21 and the mirror 22 are movable in a body in a direction indicated with arrow b at a speed of v/m (v: peripheral velocity of photosensitive drum, m: copy magnification). Also, the movable mirrors 23 and 24 are movable in a body at a speed of v/2m in the same direction. An original is placed on a platen glass 29 by the ADF 70 automatically or by the operator manually. An image is exposed on the photosensitive drum 3 in a slit-shape by the lamp 21 and the mirrors 22, 23 and 24 moving in the direction indicated with arrow b.

The feeding section 30 is composed of automatic feeding cassettes 31 through 34 which contain different sizes of sheets respectively, pick-up rollers 35, pairs of separation rollers 36 and pairs of transportation rollers 37 which are provided at each of the cassettes 31 through 34. Sheets are fed one by one from a selected cassette by the corresponding pick-up roller and transported upward by the transportation rollers 37.

In the image forming section 2, a pair of intermediate rollers 11 which transport a sheet, a pair of timing rollers 12 and a conveyor belt 13 are provided. Also, another pair of intermediate rollers 15 and a pair of ejecting rollers 16 are provided downstream of a fixing device 14. A sheet which is fed from the feeding section 30 is transported to the timing rollers 12 through the intermediate rollers 11 and stopped there once. Next, the sheet is sent to a transfer position by the timing rollers 12 in synchronization with an image which is formed on the photosensitive drum 3. After transferring the image on the sheet, the sheet is sent to the fixing device 14 by the conveyor belt 13 and the toner is fixed onto the sheet. Then, the sheet is ejected to a tray 17 by the ejecting rollers 16. Also, sensors which detect a sheet transporting position such as a sensor SE1 is provided in a sheet transporting way.

The sheet reversing unit 50 receives a first-imaged sheet and transports the sheet from a leading path 51 to a reversing path 52. When the trailing edge of the sheet passes transportation rollers 60 and 62, the sheet is switched back by reversing rollers 65 and 66 and sent from the transportation rollers 60 and 63 to the refeeding unit 100 through an ejecting path 53. In order to lead the sheet to the reversing unit 50, a diverter 18 which diverts the transporting way is provided right before the ejecting rollers 16. The diverter 18 guides the sheet to the reversing unit 50 when the diverter 18 is set at a position indicated with a full line as shown in FIG. 1, and guides the sheet to the tray 17 when the diverter 18 is set at a position rotated slightly clockwise from the above-indicated position.

[Summary of Refeeding Unit]

The refeeding unit 100 contains a first-imaged sheet (a sheet which has an image on the first side) and then refeeds the sheet at a specified timing. The refed sheet is transported from a pair of transportation rollers 195 to the timing rollers 12 through the intermediate rollers 11 and receives an image on the second side.

In the conventional refeeding unit of the copy machine, after a set number of first-imaged sheets are all contained in an intermediate tray, the copying of the second image is carried out and the sheets contained in the intermediate tray are refed. However, in this embodiment, before the first-imaged sheets are all contained in the intermediate tray 110, the refeeding (priority refeeding) from the intermediate tray 110 for the second image copying can be started.

Figure 2:
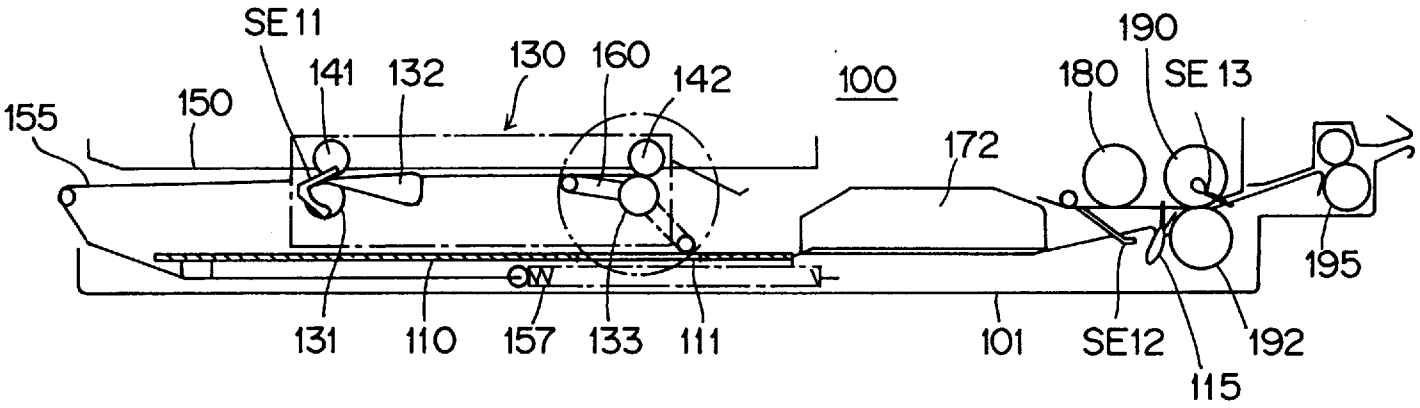
FIG. 2 is an internal elevational view of a refeeding unit which is contained in the copy machine.

In FIG. 2, the refeeding unit 100 is assembled on a frame 101 and mainly composed of the intermediate tray 110, an upper guiding plate 150, a lower guiding film 155, a containing section 130, a pick-up roller 180, a feeding roller 190 and a reversal separation roller 192. The containing section 130 is movable in a transporting direction (horizontal direction in FIG. 2) corresponding to a sheet size, and mainly composed of first containing rollers 131, a sheet detecting sensor SE11, a sheet transportation diverter 132, a second containing roller 133 and a trailing portion pressing member 160.

A sheet with a large length in a sheet transporting direction (A3 and B4 ) is contained in the intermediate tray 110 by the first containing rollers 131. At that time, the diverter 132 functions as a guide for containing the sheet from the first containing rollers 131. On the other hand, a sheet with a small length of the sheet in the sheet transporting direction (A4 and B5) is contained in the intermediate tray 110 by the second containing roller 133. At that time, the diverter 132 functions as a guide for transporting the sheet to the second containing roller 133. The movement of the containing section 130 corresponding to a sheet size is explained later.

The trailing portion pressing member 160, in the priority refeeding mode, presses a trailing portion of a sheet which is contained in the intermediate tray 110 beforehand, and prevents the sheet from being drawn by an upper sheet which is contained in the intermediate tray 110 and refed immediately. The structure and operation of the pressing member 160 will be explained later.

The intermediate tray 110 is provided with side regulating plates 171 and 172 at both sides, a leading edge regulating plate 115, an empty sensor SE12 for detecting the presence of the sheet and a sensor SE13 for detecting a refed sheet. The side regulating plate 172 moves in the width direction of the sheet every time a sheet is contained in the intermediate tray 110 and regulates a containing position of the sheet in the width direction with the side regulating plate 171 (refer to FIG. 8). The pick-up roller 180 is usually in an upper retreating position and comes down to press the sheets when the refeeding starts. With the rotation of the pick-up roller 180, a most top sheet is sent rightward in FIG. 2. The feeding roller 190 rotates in the refeeding direction and the reversal separation roller 192 rotates in the reverse direction. A relationship between a frictional power $\mu 1$ between the feeding roller 190 and the sheet, a frictional power $\mu 2$ between the separation roller 192 and the sheet and a frictional power $\mu 3$ between sheets is set $\mu 1>\mu 2>\mu 3$. Thus, when a plurality of sheets come between the rollers 190 and 192, the rollers 190 and 192 separates the most top sheet which contacts with the roller 190 with pressure from other sheets and send only one sheet.

[Priority refeeding mode]

Figure 3:
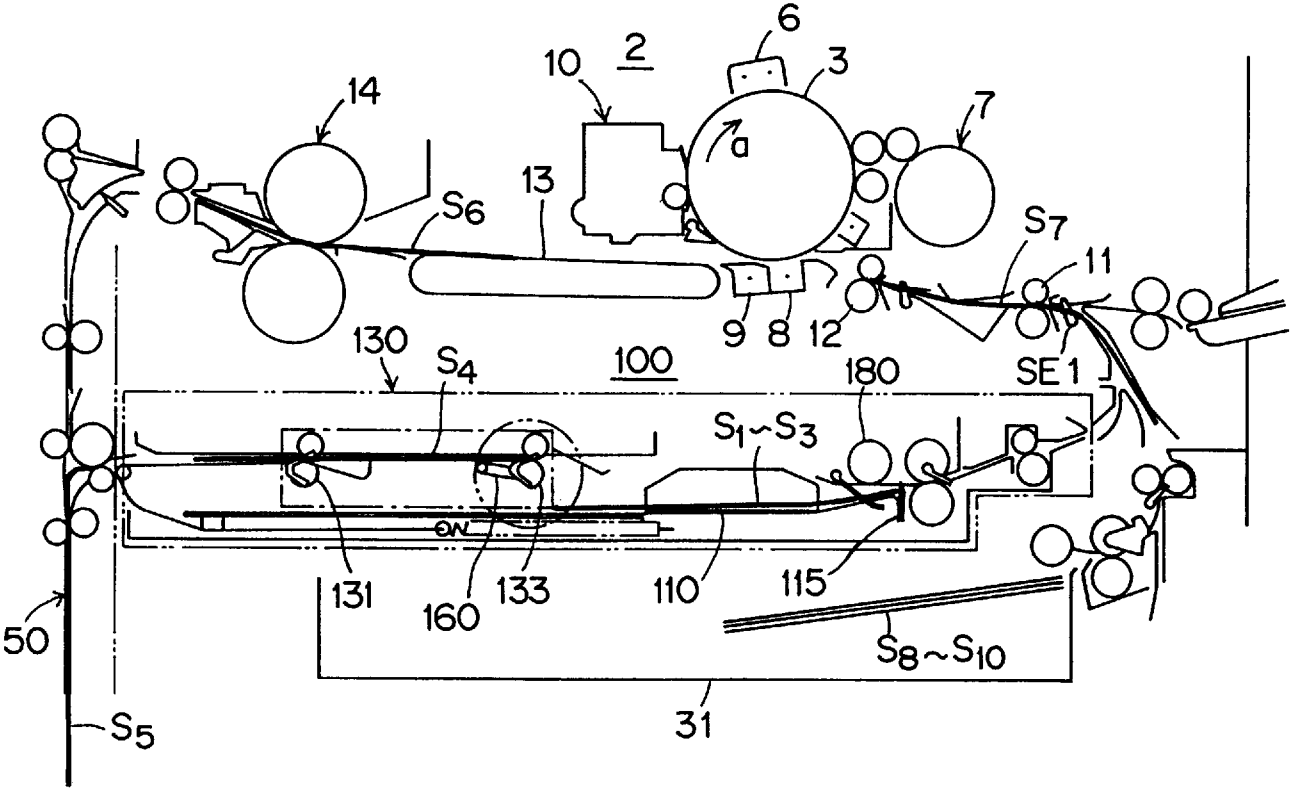
FIG. 3 is an explanatory drawing which shows a sheet transporting situation in the copy machine.
Figure 4:
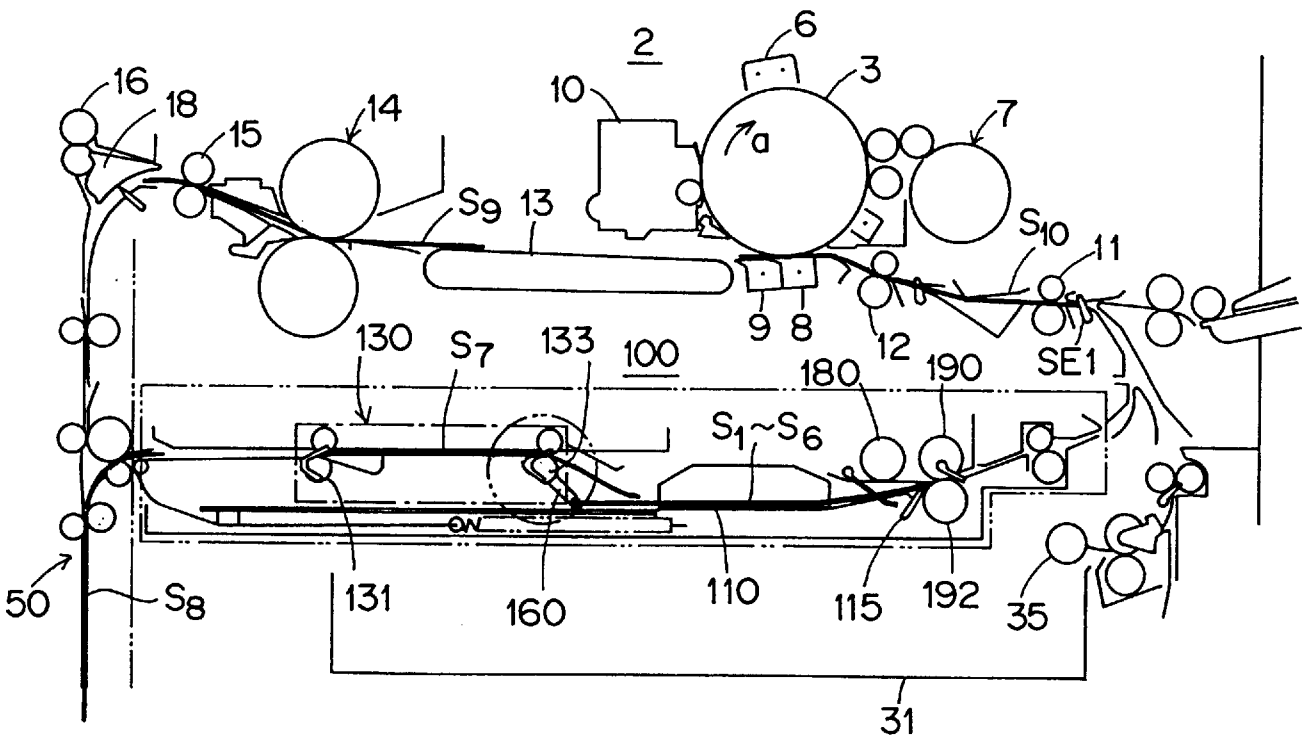
FIG. 4 is an explanatory drawing which shows the sheet transporting situation in the copy machine.

Next, the outline of copying operation in the priority refeeding mode is described referring to FIGS. 3 and 4. A case wherein 10 copies are made by copying two originals on a front and a back side of a sheet respectively is explained.

The two originals are placed on the ADF 70, and a desirable sheet size, a copy magnification and a number of copy sheets "10" are inputted from an operation panel. Then, an order to start copying operation is given by pressing a print key.

The first original is set on the platen glass 29 by the ADF 70. A sheet is fed from a feeding cassette (the feeding cassette 31 in this embodiment) which is selected according to the inputted sheet size. When the sheet is detected by the sensor SE1, a timer which determines a timing to start image scanning starts counting. When the counting is finished, a scanning of the first original is carried out, and an electronic latent image which is formed on the photosensitive drum 3 is developed by the developing device 7 to form a toner image.

The toner image is transferred onto the fed sheet at a good timing by the timing rollers 12. After the image is fixed onto the sheet, the sheet goes through the reversing unit 50 and is contained in the intermediate tray 110. This operation is repeated until the sixth sheet is contained in the intermediate tray 110.

The number of fed sheets is counted by a fed sheet counter. When the seventh sheet, which is fed from the cassette 31 by order of the counter, is detected by the sensor SE1, a delay timer starts operating and delays a scanning start timing for a specified time. Since the feeding of the seventh sheet from the cassette 31 is carried out at the same timing as that of the previously fed six sheets, the sheet is stopped longer than the previous six sheets right before the timing rollers 12. Thereby, an interval between the sixth sheet and the seventh sheet becomes longer by a time which is delayed by the delay timer.

FIG. 3 shows a position of sheets which are transported to the intermediate tray 110. The first through the third sheets $S_1$, $S_2$ and $S_3$ are contained in the intermediate tray 110, and the fourth sheet $S_4$ is at the containing section 130. The fifth sheet $S_5$ and the sixth sheet $S_6$ are at the reversing unit 50 and the fixing device 14 respectively. The seventh sheet $S_7$ is stopped at the timing rollers 12 and the eighth, the ninth and the tenth sheet $S_8$, $S_9$ and $S_{10}$ are in the feeding cassette 31.

Also, since the pick-up roller 35 and the transportation rollers 37 are driven in synchronization with the timing rollers 12, an interval between sheets which are transported from the pick-up roller 35 to the timing rollers 12 is always kept the same.

The seventh sheet $S_7$ is sent to a transfer position when the timing rollers 12 are started and contained in the intermediate tray 110 after transferring, fixing and reversing. After that, the sheets $S_8$, $S_9$ and $S_{10}$ are also sent to the transfer position at the same interval as the one between the sixth sheet and the seventh sheet. This interval is lengthened by the time which is delayed by the delay timer.

In FIG. 4, the first through the sixth sheets $S_1$ through $S_6$ are contained in the intermediate tray 110, and the trailing portion of the sheets are pressed by the pressing member 160. The seventh sheet $S_7$ is sent onto the sixth sheet $S_6$ and the trailing portion of the seventh sheet $S_7$ is placed on the first containing roller 131. Also, the eighth sheet $S_8$ is sent to the containing section 130 from the reversing unit 50. The ninth sheet $S_9$ and the tenth sheet $S_{10}$ are at the fixing device 14 and the transfer position respectively.

As soon as the light scanning for forming the first original image on the tenth sheet $S_{10}$ is finished, the ADF 70 is operated and the second original is set on the platen glass 29. At that time, the first through the sixth sheets $S_1$ through $S_6$ which are contained in the intermediate tray 110 are pressed by the pressing member 160, and the seventh sheet $S_7$ is contained on the sheets $S_1$ through $S_6$.

As the first sheet for the second original, the seventh sheet $S_7$ in the first image copying is refed from intermediate tray 110, and after the transfer of the toner image and the fixing processing, the seventh sheet $S_7$ is ejected to the tray 17 by the ejecting rollers 16.

After that, as the second sheet for the second original, the eighth sheet $S_8$ in the first image copying is used. In the same way, as the third sheet and the fourth sheet for the second image, the ninth sheet $S_9$ and the tenth sheet $S_{10}$ in the first image copying are refed respectively. After that, the first through the sixth sheets $S_1$ through $S_6$ which are contained in the intermediate tray 110 are refed successively starting with the most top sheet, that is, the sixth sheet, the fifth sheet, the fourth sheet, the third sheet, the second sheet and the first sheet are refed in order.

Figure 13:
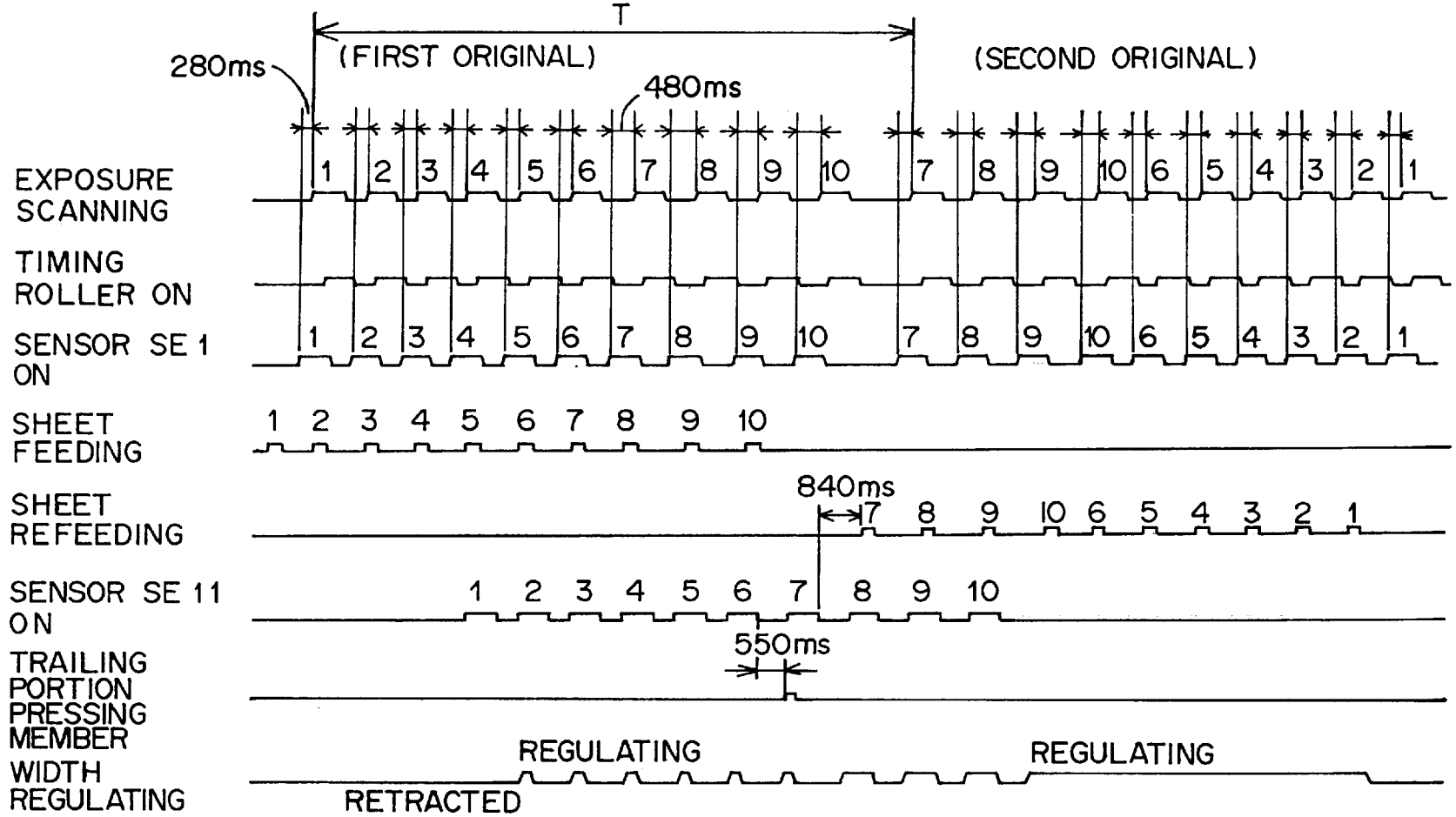
FIG. 13 is a timing chart of a feeding and a refeeding operation in a duplex copy mode of the copy machine.
Figure 14:
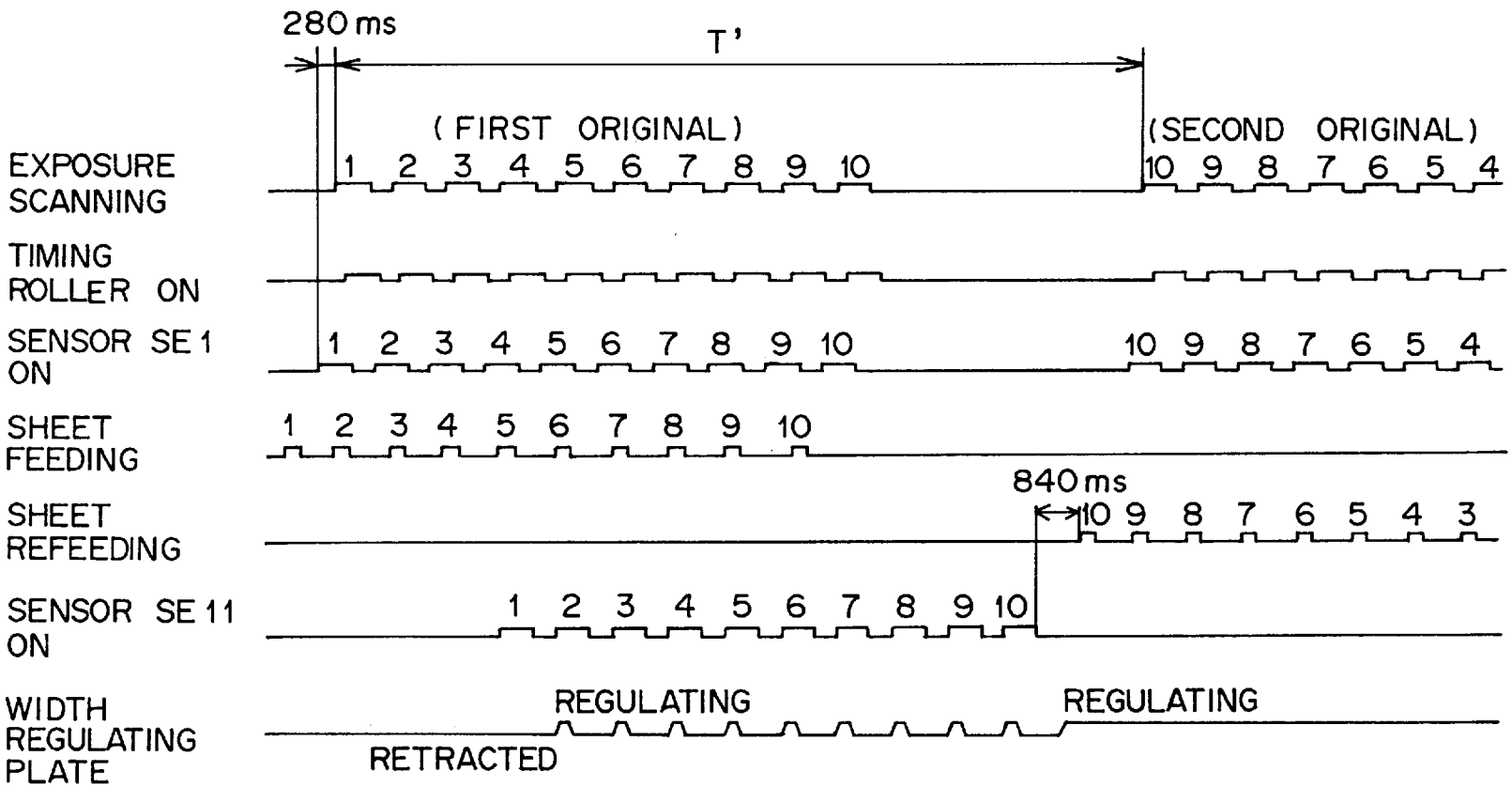
FIG. 14 is a timing chart of a feeding and a refeeding operation in a duplex copy mode of the copy machine according to a reference example (a priority refeeding is not carried out)

FIG. 13 shows the image forming operation. Since the priority refeeding is carried out from the seventh sheet, a required time from the image exposure start timing of the first image till the image exposure start timing of the second image is T. FIG. 14 shows an image forming operation in the conventional method wherein all sheets are contained in the intermediate tray 110 and refeeding is carried out from the tenth sheet. In this case, the required time is T'. In this embodiment, the copy productivity in the duplex copy mode is largely improved.

[Structure and Operation of Containing section]

The containing section 130 is movable in the containing direction in order to cope with various sheet sizes such as B5 lateral, A4 lateral, B5 vertical, A4 vertical, B4 vertical and A3 vertical and inch sizes. The "vertical" means a sheet with is transported with the longer side parallel to the sheet transporting direction, and the "lateral" means a sheet which is transported with the shorter side parallel to the sheet transporting direction.

In the refeeding unit 100, since sheets to be contained in the refeeding unit 100 already went through the fixing process, the sheets are curled. Thus, the containing section 130 needs to send these curled sheets to the intermediate tray 110 correctly. In this embodiment, the sheets are contained correctly by providing the containing rollers 131 and 133 at two places and setting either of the containing rollers at the trailing edge position of the sheet to be contained. On the other hand, the leading edge of the contained sheet is regulated by the leading edge regulating plate 115 at a specified position.

Figure 5:
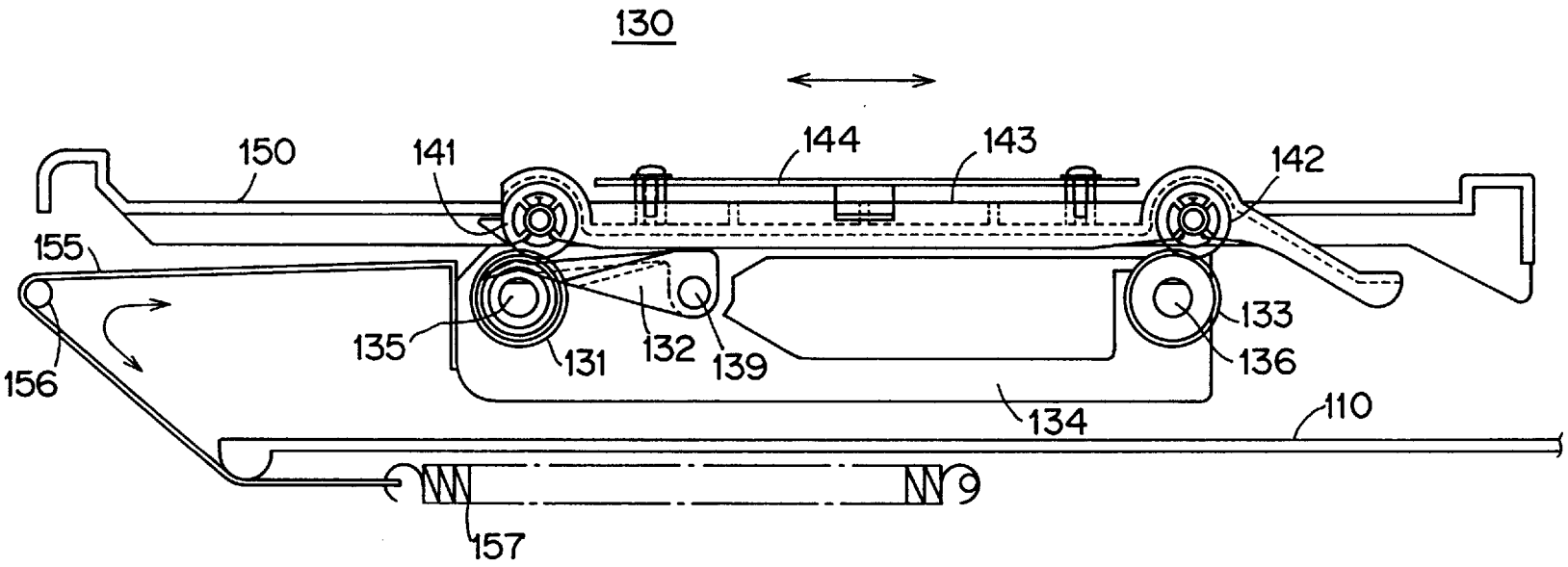
FIG. 5 is an elevational view of a containing section in the refeeding unit.
Figure 6:
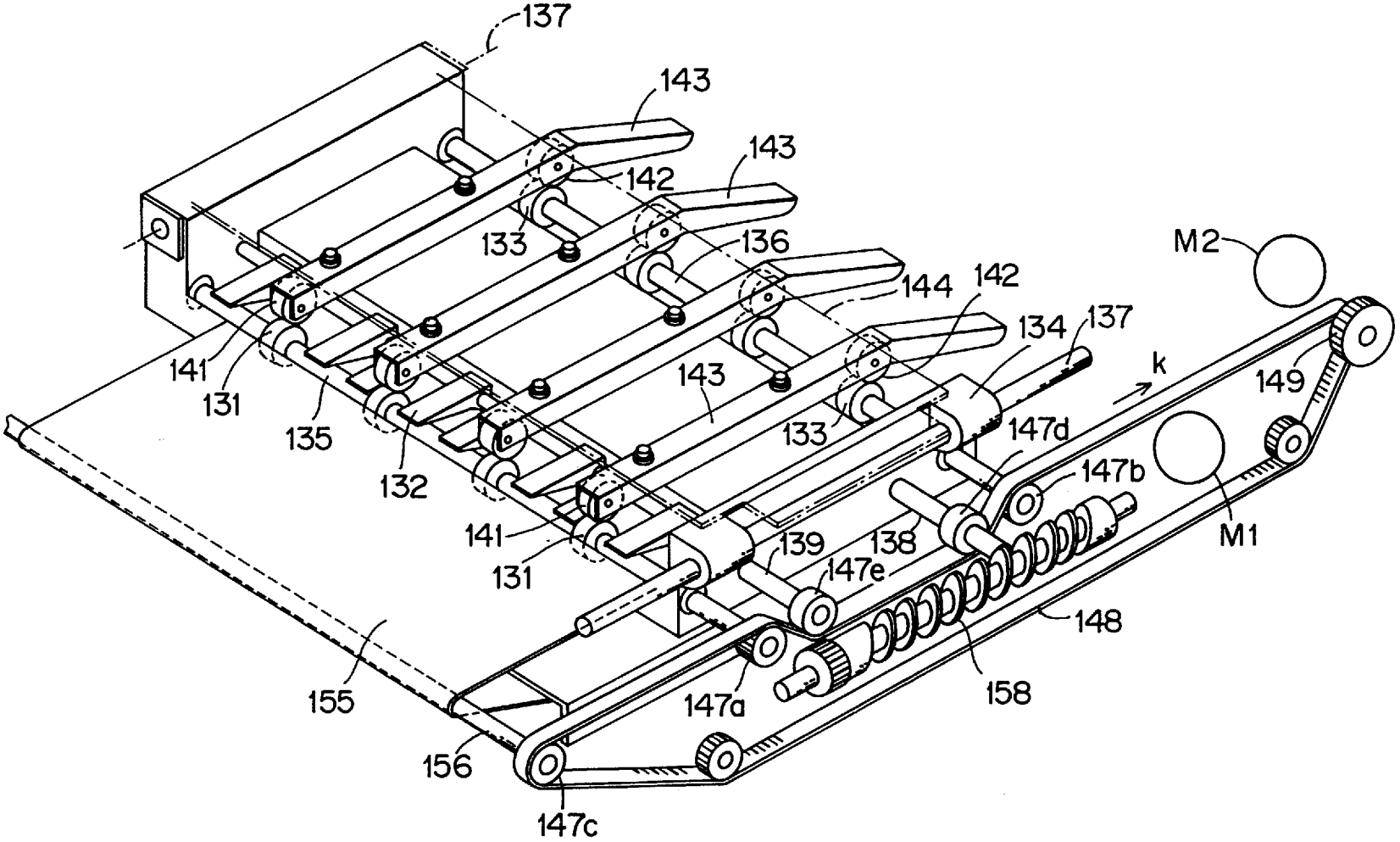
FIG. 6 is a perspective view of the containing section.
Figure 7:
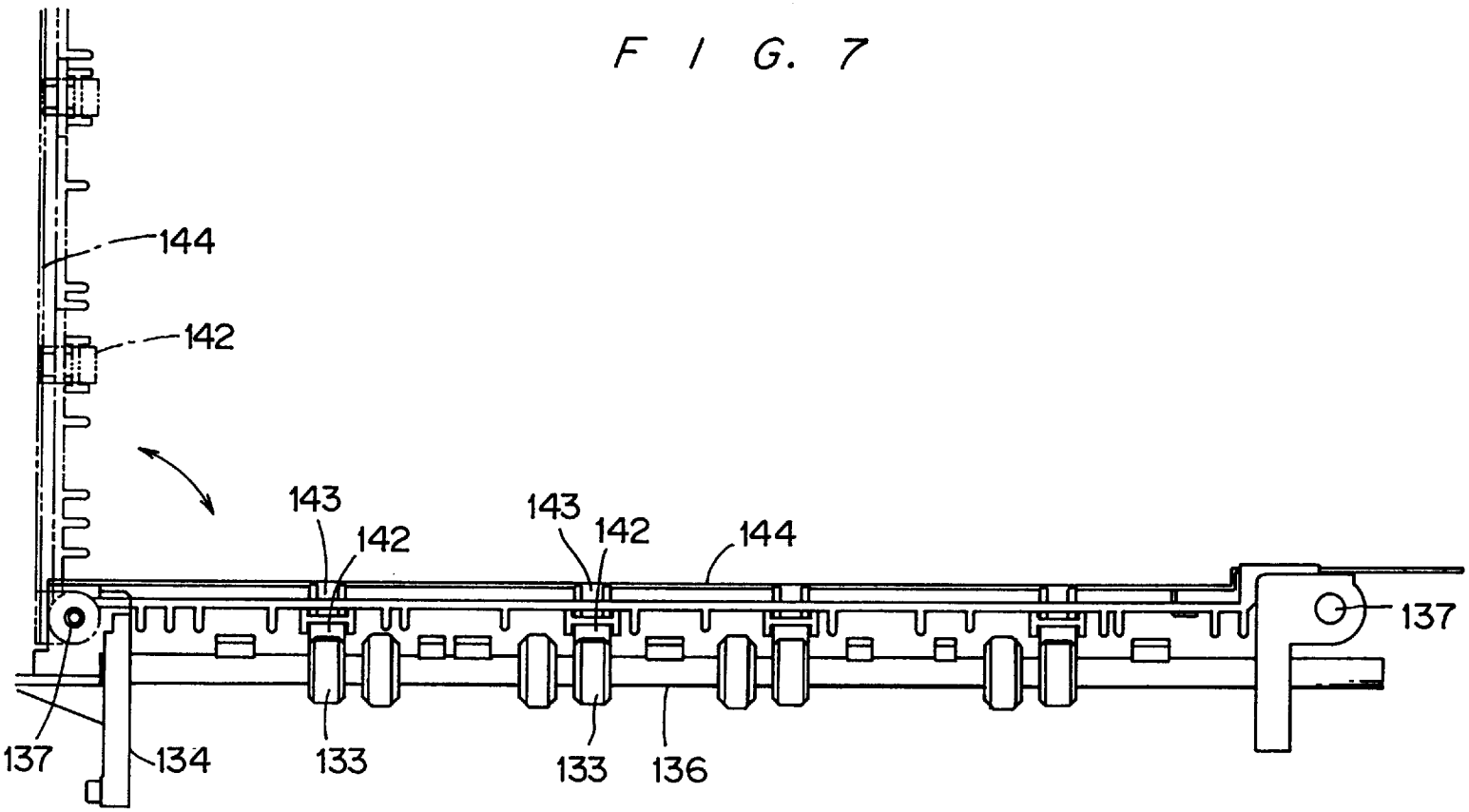
FIG. 7 is a side view of the containing section.

In FIGS. 5, 6 and 7, at the containing section 130, driven rollers 141 and 142 are in rotatable contact with the first and the second containing rollers 131 and 133. The driven rollers 141 and 142 are held by a supporting plate 144 through a holder 143. The containing rollers 131 and 133 are fixed to supporting shafts 135 and 136 at a specified interval. The supporting shafts 135 and 136 are attached to a slider. The slider 134 is attached to guiding shafts 137 and slidable thereon. The containing section 130 is moved by fitting an end of a supporting shaft 138 which is fixed to the side portion of the slider 134 with a screw cam 158 and rotating the screw cam 158 by a stepping motor M1 in a normal direction and a reversing direction.

The rotation of the containing rollers 131 and 133 is driven by rotating an endless timing belt 148 fitted around gears 147*a* and 147*b* which are fixed to ends of the supporting shafts 135 and 136 and a gear 147*c* which is fixed to an end of the supporting shaft 156 of a lower guiding film 155 in a direction indicated with arrow k by a driving power of a motor M2 which is sent from the gear 149. Also, the timing belt 148 is given a specified tension by rollers 147*d* and 147*e* which are attached to the supporting shafts 138 and 139 which are provided with the slider 134.

The diverter 132 is provided at the supporting shaft 139, and the sheet transporting way is changed by a solenoid (not shown).

The driven rollers 141 and 142 come into contact with the containing rollers 131 and 133 through slits (not shown) which are formed on the upper guiding plate 150. The holder 143 of the driven rollers 141 and 142 is held movable together with the slider 134 on the upper guiding plate 150 through a supporting plate 144. As shown in FIG. 7, the upper guiding plate 150 can be opened upward pivoting on a guiding shaft 137 which is provided at the back side of the copy machine. When the upper guiding plate 150 is opened, the driven rollers 141 and 142 are lifted together with the upper guiding plate 150. In this structure, the sheet containing path can be wholly opened. Thus, a jammed sheet releasing process in the containing section 130 becomes easy.

The lower guiding film 155 is a flexible plastic film. As shown in FIGS. 5 and 6, the end of the lower guiding film 155 is fixed to the slider 134, and the lower guiding film 155 is held horizontal by a supporting shaft 156. The lower guiding film 155 is kept elastic by pulling the other end of the lower guiding film 155 by a coil spring 157. As the containing section 130 is moving, the length of the guiding portion of the lower guiding film 155 which extends rightward from the supporting shaft 156 is changed. However, the guiding portion can always be kept horizontal by the elasticity of the coil spring 157. In this embodiment, as the lower guiding film 155, a polyester film with a thickness of 50 $\mu$m is used. The surface of the polyester film is finished with the mud processing.

Also, various flexible materials can be used as the guiding film 155. An upper guiding film can be composed in the same structure as the lower guiding film 155. Or a plurality of wires can be provided instead of the lower guiding film 155. Also, a weight can be used as means for giving a tension to the film or the wire instead of the coil spring 157.

[Relationship between Containing section and Sheet Size]

Figure 9A:
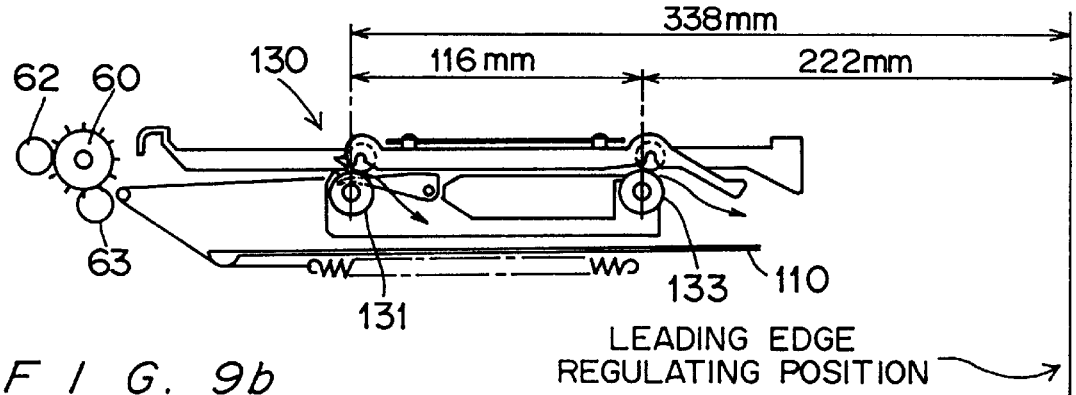
FIGS. 9*a*, 9*b* and 9*c* are explanatory drawings which show a moving situation of the containing section.
Figure 9B:
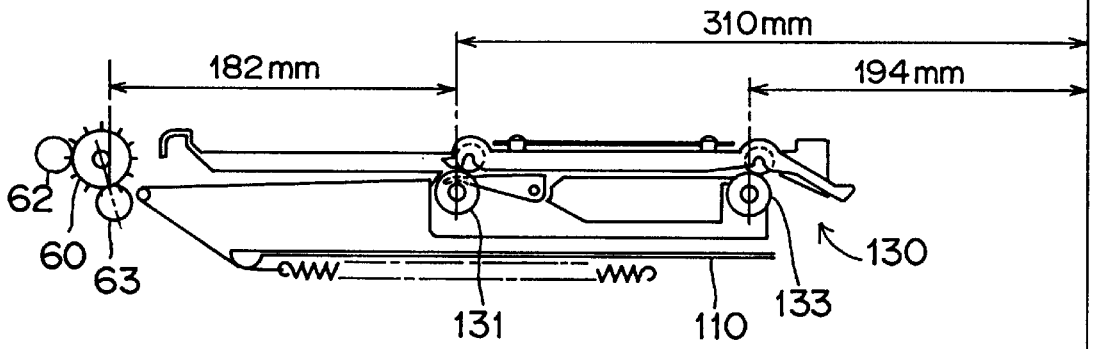
Figure 9C:
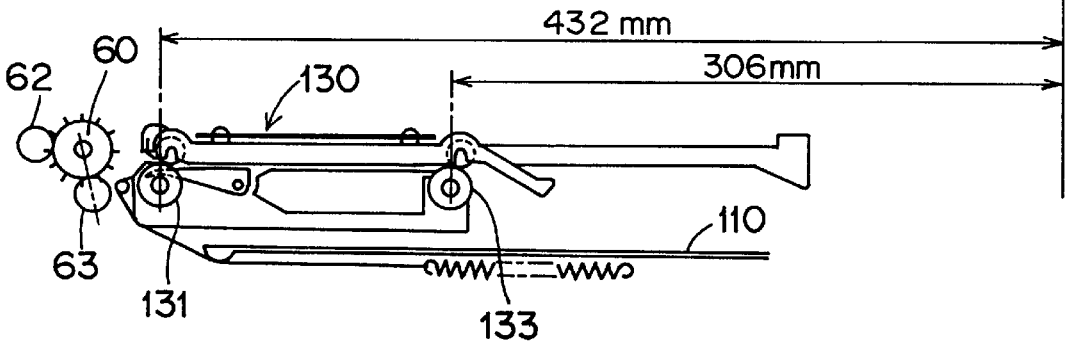

In FIGS. 9*a*, 9*b* and 9*c*, a space between the containing rollers 131 and 133 needs to be shorter than a length of the smallest sheet size (a length in the containing direction). And also, when the containing section 130 moves to the containing position of smallest sheet size (refer to FIG. 9*b*), a space between the first containing roller 131 and the nipping portion of the transportation rollers 60 and 63 needs to be shorter than the length of the smallest sheet size. In this embodiment, the largest size of the sheet is A3 vertical (length 420 mm), the smallest size is B5 lateral (182 mm), and a space between the containing rollers 131 and 133 is 116 mm.

FIG. 9*a* shows a home position of the containing section 130. This is equal to a position wherein A4 lateral sheet (length 210 mm) is contained from the second containing roller 133 to the intermediate tray 110. More specifically, the position of the second containing roller 133 is determined by adding a sheet length (210 mm), a radius of the containing roller 133 (9 mm) and an allowance for unevenness of the sheet position (3 mm). Thus, the home position of the second containing roller 133 is 222 mm away from the leading edge regulating position. In this position, a length between the first containing roller 131 and the leading edge regulating position is 338 mm. Thus, a sheet whose size corresponds to this length can be sent from the first containing roller 131 to the intermediate tray 110.

When a sheet whose length is shorter than A4 lateral is contained, the containing section 130 is moved rightward (refer to FIG. 9*b*). FIG. 9*b* shows a position which corresponds to B5 lateral sheet (length 182 mm), the smallest size used in this embodiment. In this position, a sheet of B5 lateral is sent from the second containing roller 133 to the intermediate tray 110. Also, a length between the first containing roller 131 and the leading edge regulating position is 310 mm, and a sheet which corresponds to this length (A4 vertical) can be sent from the first containing roller 131 to the intermediate tray 110.

When the largest size A3 vertical (length 420 mm) is contained, the containing section 130 is moved leftward (refer to FIG. 9*c*). In this position, a length between the first containing roller 131 and the leading edge regulating position is 432 mm, and the sheet is sent from the first containing roller 131 to the intermediate tray 110.

In the above structure, by moving the containing section 130 according to the sheet size (A and B sizes and inch sizes), in this embodiment, any sheet of a size from B5 lateral (smallest) to A3 vertical (largest) can be contained by either the first containing roller 131 or the second containing roller 133.

It is possible that only either the first containing roller 131 or the second containing roller 133 is provided and all sizes of sheets are sent by one containing roller to the intermediate tray 110. In this way, the structure can be simplified. However, the moving length of the containing section 130 becomes large, and the moving time when the sheet size is changed also becomes large. Accordingly, the start of copying operation is delayed. Also, if three containing rollers are used, the moving length and the moving time can be smaller, however, the structure becomes complicated. Considering these points, it is preferable to use two containing rollers 131 and 133.

In order to drive the screw cam 158 for moving the containing section 130, it is preferable that a stepping motor is used as a driving source to stop the containing section 130 in an accurate position and to simplify the structure. However, the stepping motor has a problem that if the stepping motor is driven at an unsuitable rotation number (pulse rate) to load, abnormal noise is made by step-out or resonance of the motor. In this embodiment, as shown in FIGS. 5 and 6, because the lower guiding film 155 is always pulled by the coil spring 157, when the containing section 130 is moved leftward, a load on the motor is decreased by the pulling power of the coil spring 157. On the other hand, when the containing section 130 is moved rightward, the load on the motor is increased. Therefore, if the driving rotation number of the motor is suited to the load which is applied when the containing section 130 is moved rightward, when the containing section 130 is moved leftward, the load on the motor becomes small and may cause the abnormal noise.

The first countermeasure for solving this problem is to change the driving rotation number of the motor according to the load applied to the motor. When the containing section 130 is moved rightward, the load on the motor is increased. Thus, the driving rotation number is set small. When the containing section 130 is moved leftward, the load on the motor is decreased. Thus, the driving rotation number is set large. In this measurement, as the motor is driven at a suitable number of rotation according to the load on the motor, no step-out or resonance is caused. Therefore, the containing section 130 is moved smoothly.

The second countermeasure is to rotate the timing belt 148 which rotates the containing rollers 131 and 133 shown in FIG. 6 in a direction indicated with arrow k when the containing section 130 is moved rightward. A power for moving the containing section 130 rightward is generated by the rotation of the timing belt 148. Thus, if the timing belt 148 is rotated when the containing section 130 is moved rightward, the increase of the pulling power caused by the coil spring 157 can be restrained. Therefore, the same load is applied to the motor whether the containing section 130 is moved rightward or leftward. The driving rotation number of the motor is set according to the load which is applied to the motor when the containing section 130 is moved leftward. And, the load on the motor when the containing section 130 is moved rightward is adjusted to the load when the containing section 130 is moved leftward by rotating the timing belt 148 then.

[Trailing Portion Pressing Member and Priority Refeeding Operation]

In this embodiment, in making four or less duplex copies in the duplex copying mode, first-imaged sheets are not stocked on the intermediate tray 110, and the priority refeeding is carried out successively. In making five or more duplex copies, last four first-imaged sheets are not stocked in the intermediate tray 110 and refed successively in the priority refeeding. In this case, the first-imaged sheets other than the last four sheets are contained in the intermediate tray 110, and while the four first-imaged sheets are refed in the priority refeeding, the sheets contained in the intermediate tray 110 must be prevented from being drawn by the refed sheets.

Figure 8:
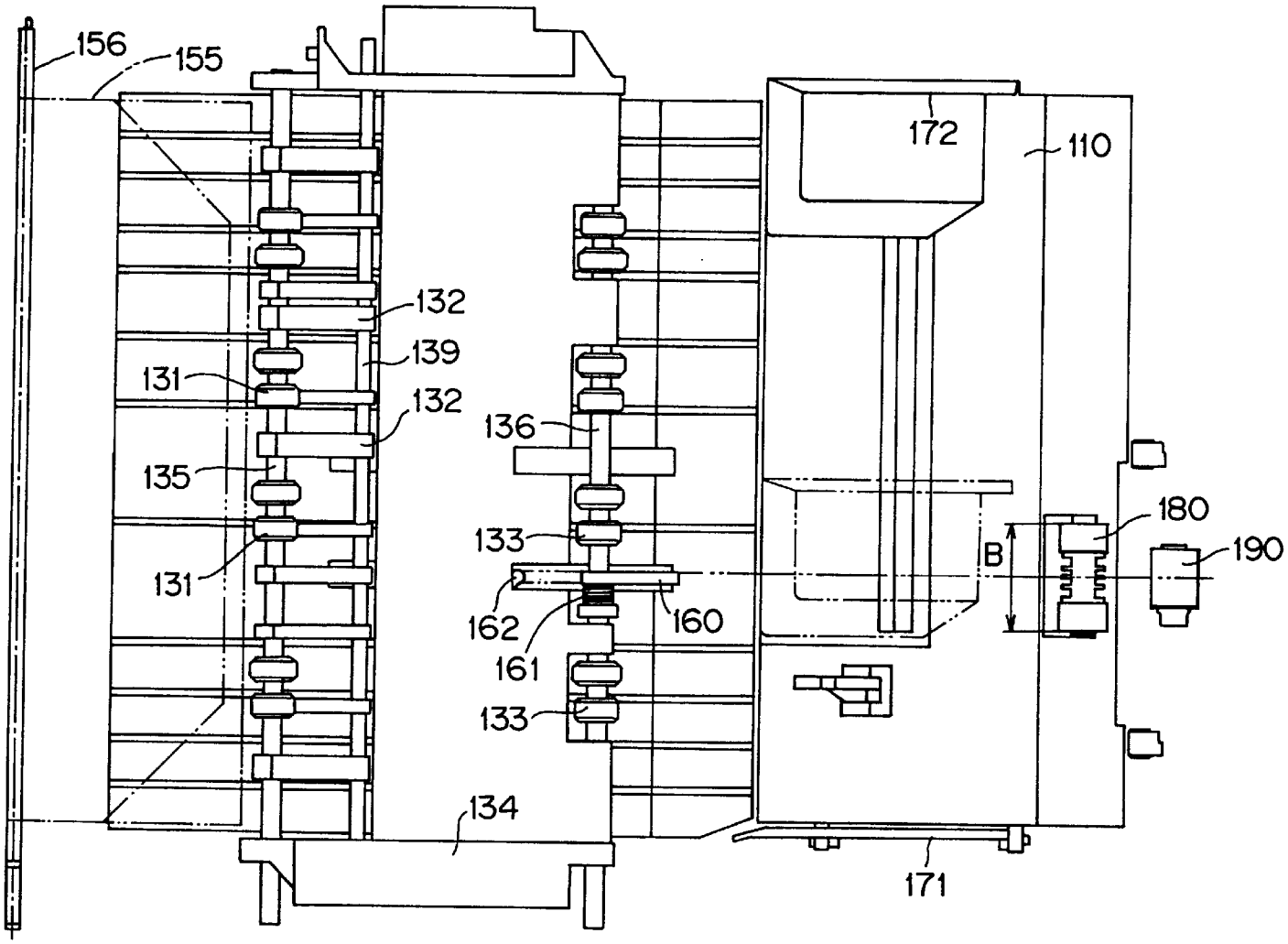
FIG. 8 is a plan view of the containing section.
Figure 10:
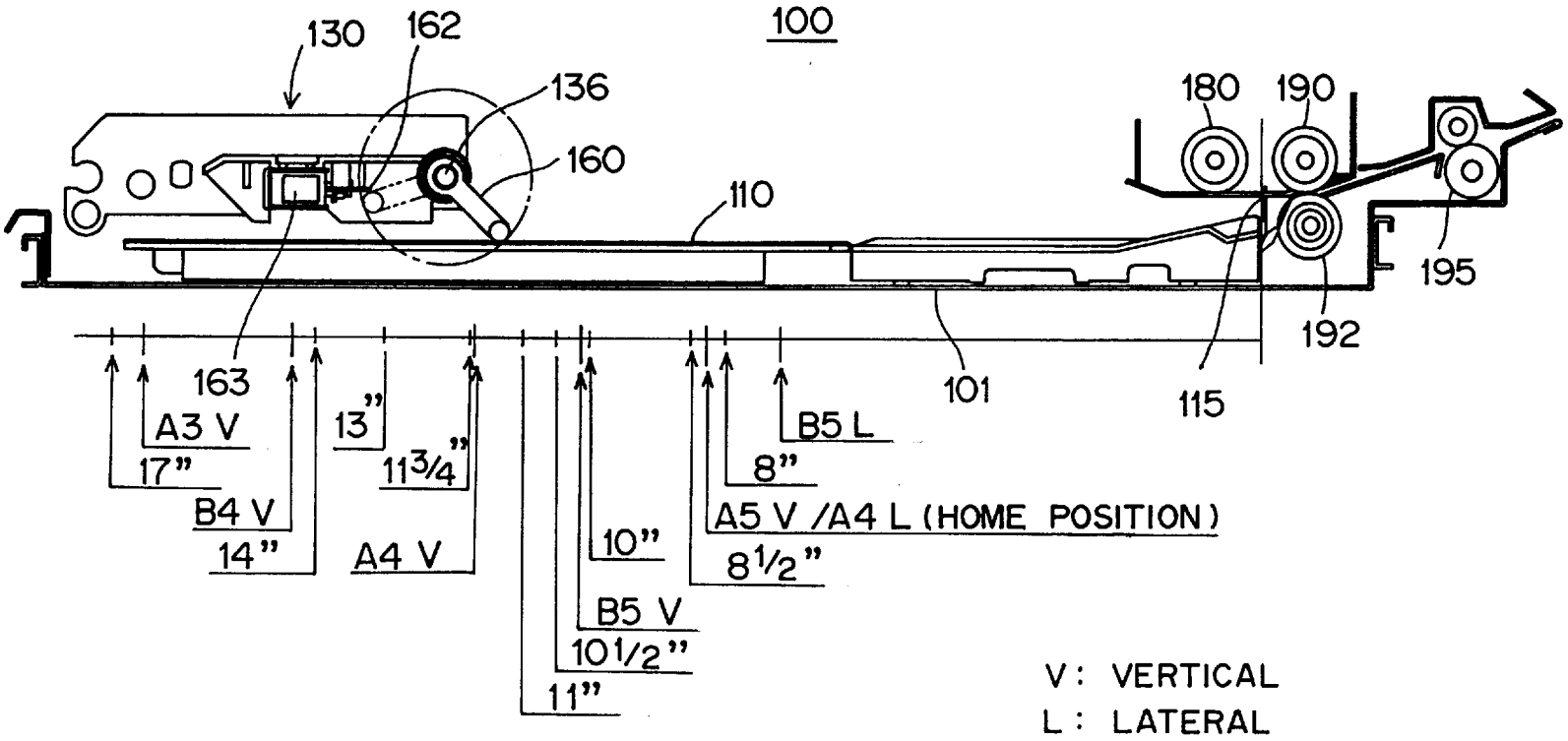
FIG. 10 is an explanatory drawing which shows positions of the containing section corresponding to each sheet size.

Therefore, the trailing portion pressing member 160 is provided to press the trailing portion of the sheets contained in the intermediate tray 110 and prevents the contained sheets from being drawn by the refed sheets. As shown in FIGS. 2 and 8, the pressing member 160 is provided at the supporting shaft 136 of the second containing roller 133 through a torque limiter 161. When the pressing member 160 is free, it rotates with the supporting shaft 136 clockwise in a body. A stopper 162 is provided to keep the pressing member 160 in the home position (refer to FIGS. 8 and 10). With the stopper 162, the pressing member 160 is set right under the containing way as shown with full line in FIG. 2. The stopper 162 moves leftward when a solenoid 163 is turned on (refer to FIG. 10) and releases the pressing member 160. Thereby, the pressing member 160 rotates with the supporting shaft 136 and presses the trailing portion of the sheets which are contained in the intermediate tray 110. Meanwhile, the torque limiter is released, and the pressing member 160 keeps the sheet pressing position (refer to a dashed line in FIG. 2).

A slit 111 is formed in the intermediate tray 110. When the last sheet is refed from the intermediate tray 110, the load applied to the pressing member 160 becomes zero. Accordingly, the pressing member 160 goes through the slit 111 and rotates, and then returns to the home position which is regulated by the stopper 162.

The pressing member 160 is released from the regulation of the stopper 162, that is, started operating when the first-imaged sheet which is the fifth from the last passes through the second containing roller 133. If the pressing member 160 is started before this, since the sheet is still in between the second containing roller 133 and the driven roller 142, the sheet may be stuck. When the inputted number of copies is "10", the pressing member 160 is released from the regulation of the stopper 162 when the sixth sheet passes through the second containing roller 133, more specifically, 550 milliseconds after the trailing edge of the sixth sheet is detected by the sheet detecting sensor SE11 (sensor off) (refer to FIG. 13). As explained above, by prohibiting the operation timing of the pressing member 160 until the trailing edge of the sheet passes through the second containing roller 133, sticking of the sheet can be prevented.

Also, in this embodiment, the pressing member 160 is started such that not only an interference of the pressing member 160 with the trailing portion of the sheet which is the fifth from the last is created but also an interference with the leading portion of the next sheet is prevented. Thus, in order to prevent the sending of the next sheet into the intermediate tray 110 while the pressing member 160 is moving from the home position onto the sheets, the feed timing of the first sheet to be refed in the priority refeeding is delayed. For example, in making duplex copies, the feed timing of the seventh through the tenth sheets is delayed. If the priority refeeding is carried out without using the pressing member 160, only intervals among the sheets to be refed in the priority refeeding are lengthened. In the above example, the feeding timing of the eighth through the tenth sheets is delayed. However, in this embodiment wherein the pressing member 160 is moved after the last sheet to be stocked in the intermediate tray 110 is sent into the tray 110 and before the first sheet to be refed in the priority refeeding is sent into the tray 110, the delay of the feed timing is started with one sheet advanced than the case not using the pressing member 160. Thereby, the interference between the pressing member 160 and the next copying sheet can be surely prevented.

The priority refeeding operation is explained referring to FIGS. 12*a* through 12*j*. This is an example when ten copies are made in the same magnification using A4 lateral sheets.

A first through a sixth first-imaged sheets $S_1$ through $S_6$ are contained successively in the intermediate tray 110.

Figures 12A, 12B, 12C, 12D:
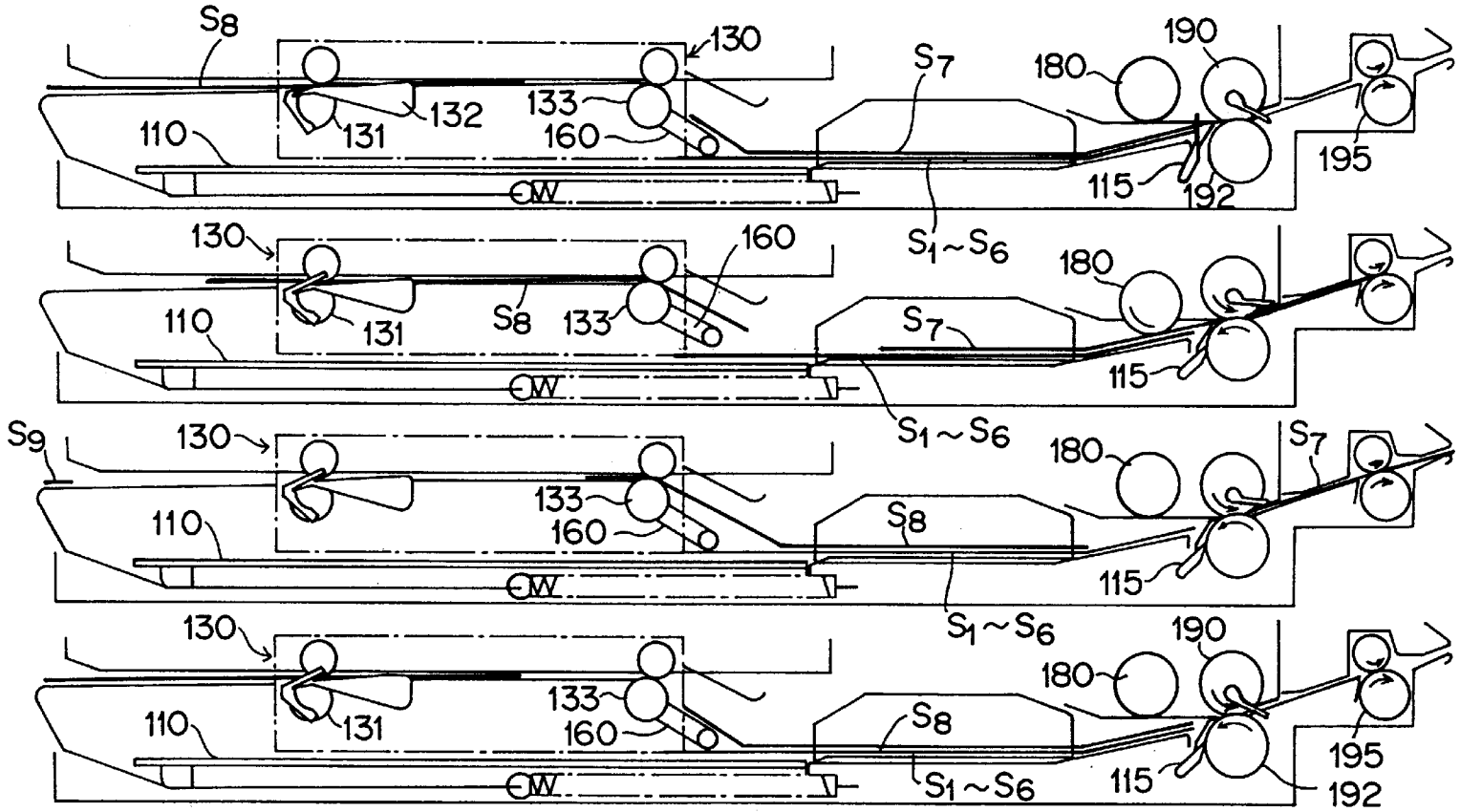
FIGS. 12*a* through 12*j* are explanatory drawings which show a priority refeeding operation.
Figures 12E, 12F, 12G, 12H:
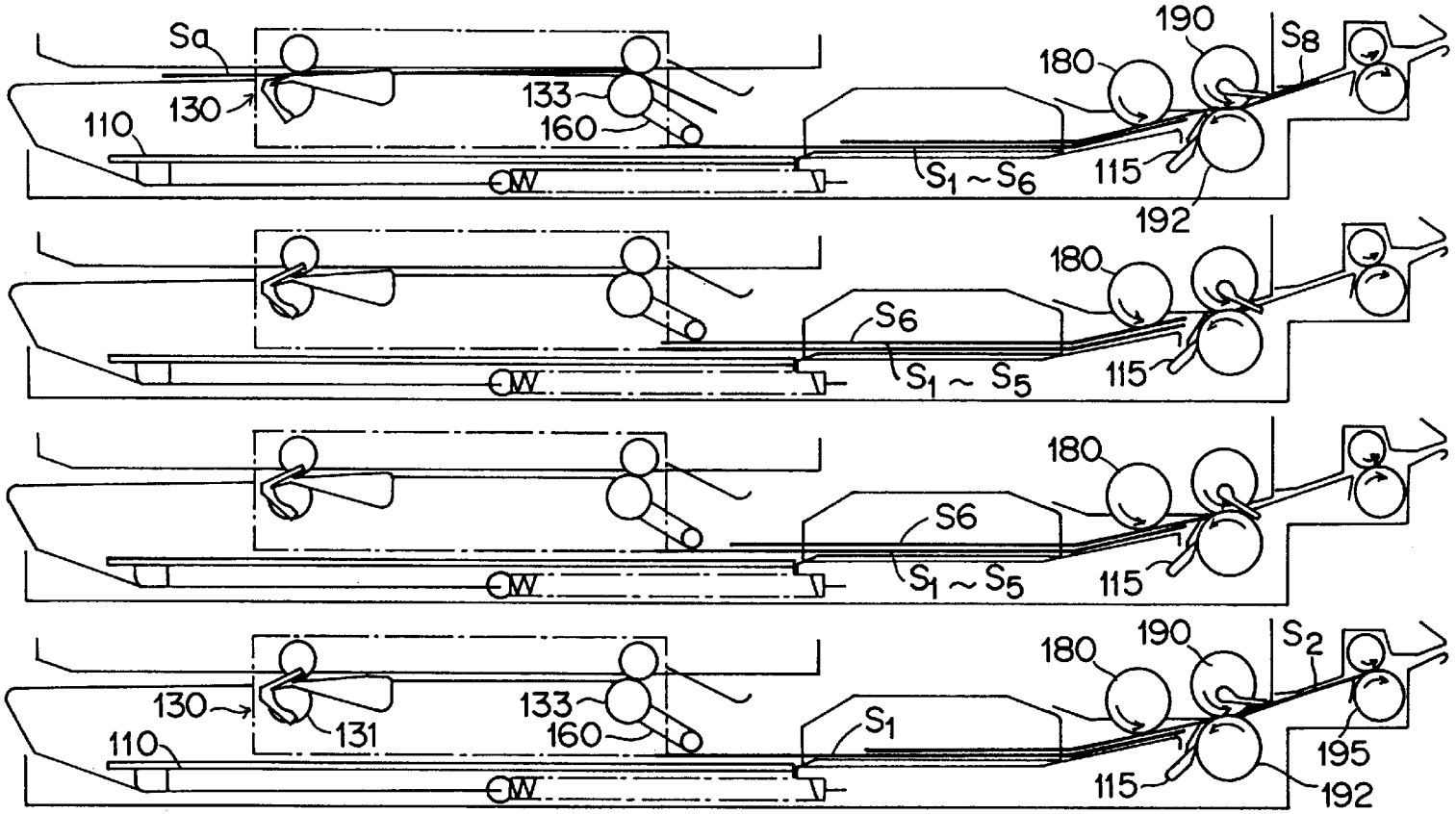
Figures 12I, 12J:
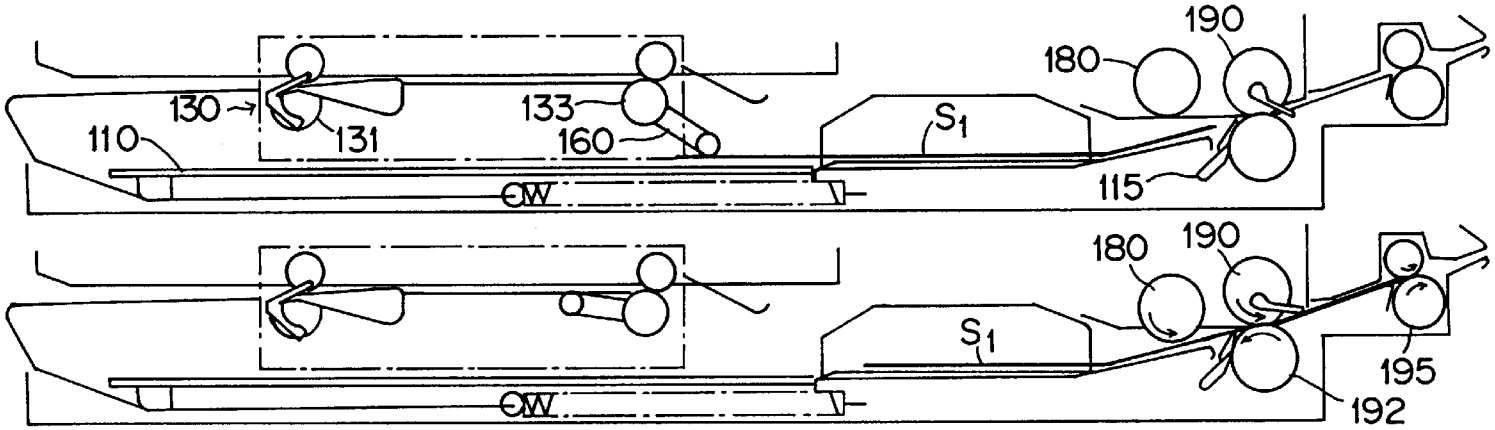

After the trailing edge of the sixth sheet $S_6$ passes through the second containing roller 133, the pressing member 160 is operated to press the trailing portion of the sheets $S_1$ through $S_6$ as explained above. The seventh sheet $S_7$ is sent into the intermediate tray 110 going above the pressing member 160 (refer to FIG. 12*a*). When the sheet $S_7$ is contained, the sheet $S_7$ is released from the regulation of the leading edge regulating plate 115, and at the same time, the pick-up roller 180 goes down and rotates to refeed the sheet $S_7$ in the priority refeeding. At that time, a power that the sheet $S_7$ draws the sixth sheet $S_6$ is generated. However, since the pressing power of the pressing member 160 is set stronger than this drawing power, the sheet $S_6$ is not drawn rightward by the sheet $S_7$ (refer to FIG. 12*b*). Next, an eighth sheet $S_8$ is sent into the intermediate tray 110. At that time, though the leading edge regulating plate 115 does not work, a rightward movement of the sheet $S_6$ is prevented by the pressing member 160 (FIGS. 12*c* and 12*d*). The priority refeeding of the sheet $S_8$ and the containing and the priority refeeding of the sheets $S_9$ and $S_{10}$ are carried out in the same way.

Next, the sheets $S_1$ through $S_6$ which are contained in the intermediate tray 110 are refed successively from the most top sheet. At that time, although each sheet $S_1$ through $S_6$ is still pressed by the pressing member 160, since the feeding power generated by the pick-up roller 180 is set stronger than the pressing power of the pressing member 160, the sheets $S_6$ through $S_1$ are refed successively one by one.

In this embodiment, the pressing member 160 is provided at the supporting shaft 136 of the second containing roller 133. The advantages of this arrangement are explained. First, while the pressing member 160 presses the contained sheets, it does not interrupt the transportation of the sheet in the priority refeeding. Second, as the pressing member 160 is moved together with the containing section 130, the pressing position is fixed regardless of the sheet size. Third, since the pressing member 160 operates and presses the sheets and comes back to the home position by the rotating power of the second containing roller 133, a driving source for exclusive use is not necessary. Fourth, since the home position of the pressing member 160 can be sent in the containing section 130, an extra space for the pressing member 160 is not necessary.

Figure 11:
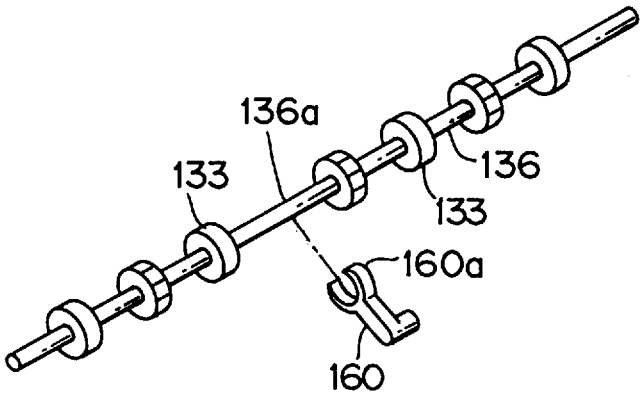
FIG. 11 is a perspective view which shows an installing structure of a trailing portion pressing member.

Especially, an ability to transmit the driving power from the supporting shaft 136 to the pressing member 160 is extremely advantageous. With the torque limiter 161 inbetween, necessary operation can be carried out. The torque limiter 161 complicates the assembly of the second containing roller 133 a little. In order to solve this problem, as shown in FIG. 11, a boss portion 160*a* of the pressing member 160 can be engaged with the supporting shaft 136. In this case, the pressing member 160 is rotated by a friction between the boss portion 160*a* and the supporting shaft 136. When a load is generated (while the pressing member 160 is pressing the sheets or is in contact with the stopper 162), the boss portion 160*a* and the supporting shaft 136 are slipped. In this structure, only an inner diameter of the boss portion 160*a* and an outer diameter of an engaging portion 136*a* of the supporting shaft 136 are needed to be controlled accurately in production. This is easier than controlling an inner diameter of the coil spring and an outer diameter of the shaft. Moreover, the number of parts and the number of assembling processes are decreased thereby.

Also, in this embodiment, the pressing member 160 is only provided at the supporting shaft 136 of the second containing roller 133, and only sheets of small sizes which pass through the second containing roller 133 can be refed in the priority refeeding. In order to refeed sheets of large sizes which are sent into the intermediate tray 110 by the first containing roller 131 in the priority refeeding, the pressing member 160 needs to be provided also at the supporting shaft 135. However, this increases the number of parts, makes the size of the containing section 130 larger, and increases the production cost. Since the duplex copying is usually carried out using small size sheets, the copy productivity using small size sheets is needed to be improved. It is not a good idea to make the priority refeeding of large size sheets possible because it causes the above problems. This embodiment provides the decrease of the number of parts, the downsizing of the refeeding unit 100 and the decrease of the production cost.

The pressing member 160 is preferably provided within a width B (refer to FIG. 8) of the pick-up roller 180 in the sheet transporting direction. This is to prevent skew of a sheet which is refed by the pick-up roller 180. FIG. 8 shows a case wherein various sizes of sheets are transported having one side of the sheet as a standard. Even in a case wherein the sheet is transported having the center of the sheet as a standard, the pressing member 160 is preferably provided within the width of the pick-up roller 180. In either of the cases, it is the best to have the center of the pick-up roller 180 and the pressing position of the pressing member 160 located in a straight line.

[Control section]

Figure 15:
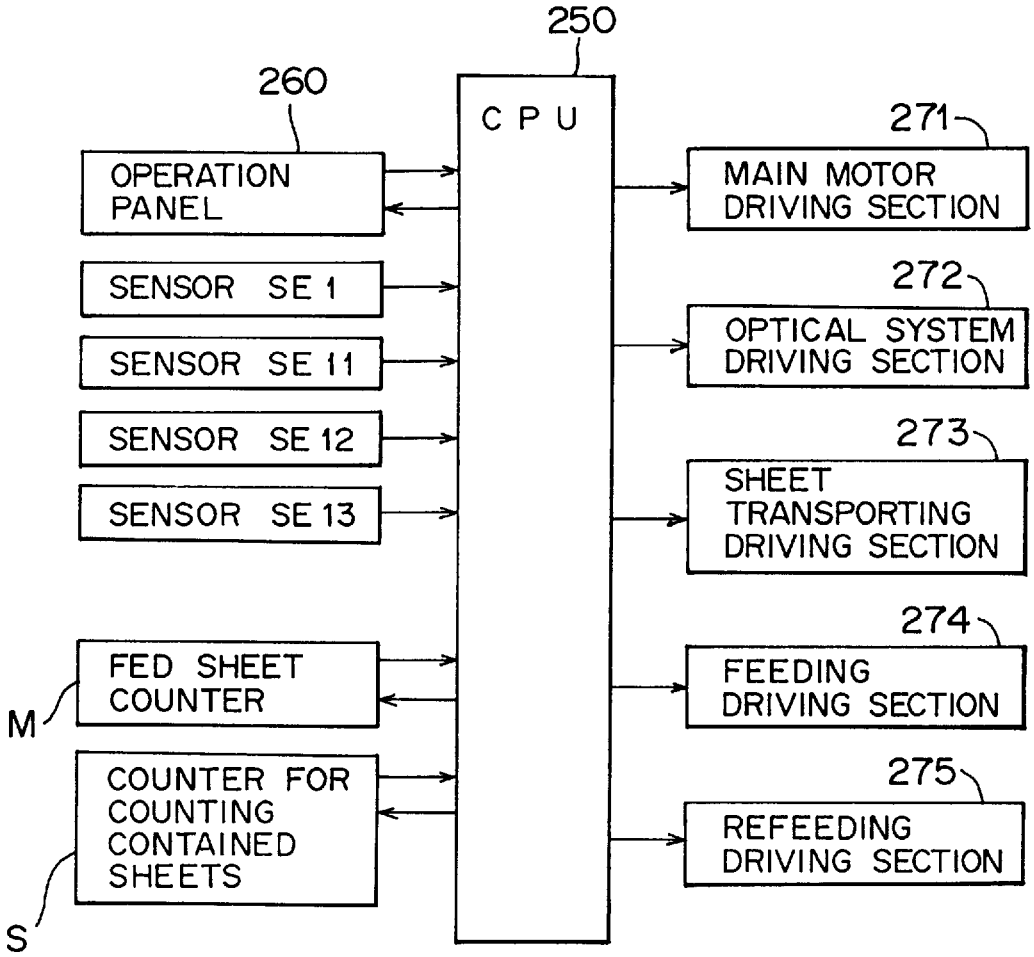
FIG. 15 is a block diagram which shows a control circuit of the copy machine.

FIG. 15 shows a control circuit of the copying machine body 1. The machine is controlled by a CPU 250. The CPU 250 receives signals from various key switches which are provided at an operation panel 260 and sends signals to various indicators. Also, the CPU 250 sends signals to a main motor driving section 271, an optical system driving section 272, a sheet transporting driving section 273, a feeding driving section 274 and a refeeding driving section 275. Also, the CPU 250 receives signals from the sensors SE1, SE11, SE12, SE13 and other sensors. Further, the CPU 250 has a fed sheet counter M which is required for controlling the copying operation and a counter S for counting sheets which are contained in the intermediate tray 110.

[Control Procedure]

Figure 16:
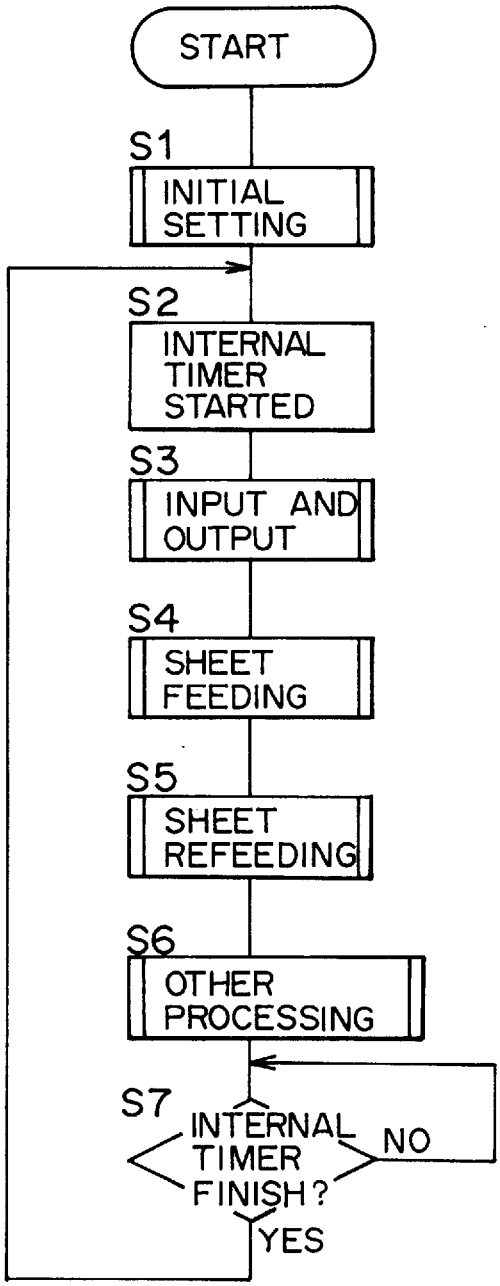
FIG. 16 is a flowchart which shows a main routine of a CPU which composes the control circuit.

FIG. 16 shows a main routine of the CPU 250.

When the power is turned on, the CPU 250 is reset and a program is started. First, initial setting for clearing a built-in RAM and various registers and setting each device in a initial mode are carried out at step S1. Next, an internal timer is started at step S2. The internal timer determines a required time for carrying out one routine in this main routine, and the required time is set at step S1 beforehand.

Next, each subroutine at steps S3 through S6 is called successively, and necessary processing is carried out. At step S3, selecting signals for selecting a sheet size, a number of copies, a copying magnification, a copying density and a copy mode (normal or duplex/composite copy) which are inputted through various key switches of the operation panel 260, detecting signals from various sensors and output signals to various indicators are processed. At step S4, sheet feeding from the feeding section 30 is controlled. At step S5, sheet refeeding from the refeeding unit 100 is controlled. At step S6, the copying operation and the movement of the containing section 130 are controlled.

At last, at step S7, after the internal timer is finished, the operation goes back to Step S2. The count of various timers which are used in the subroutines is carried out by using a time unit of this one routine.

Figure 17:
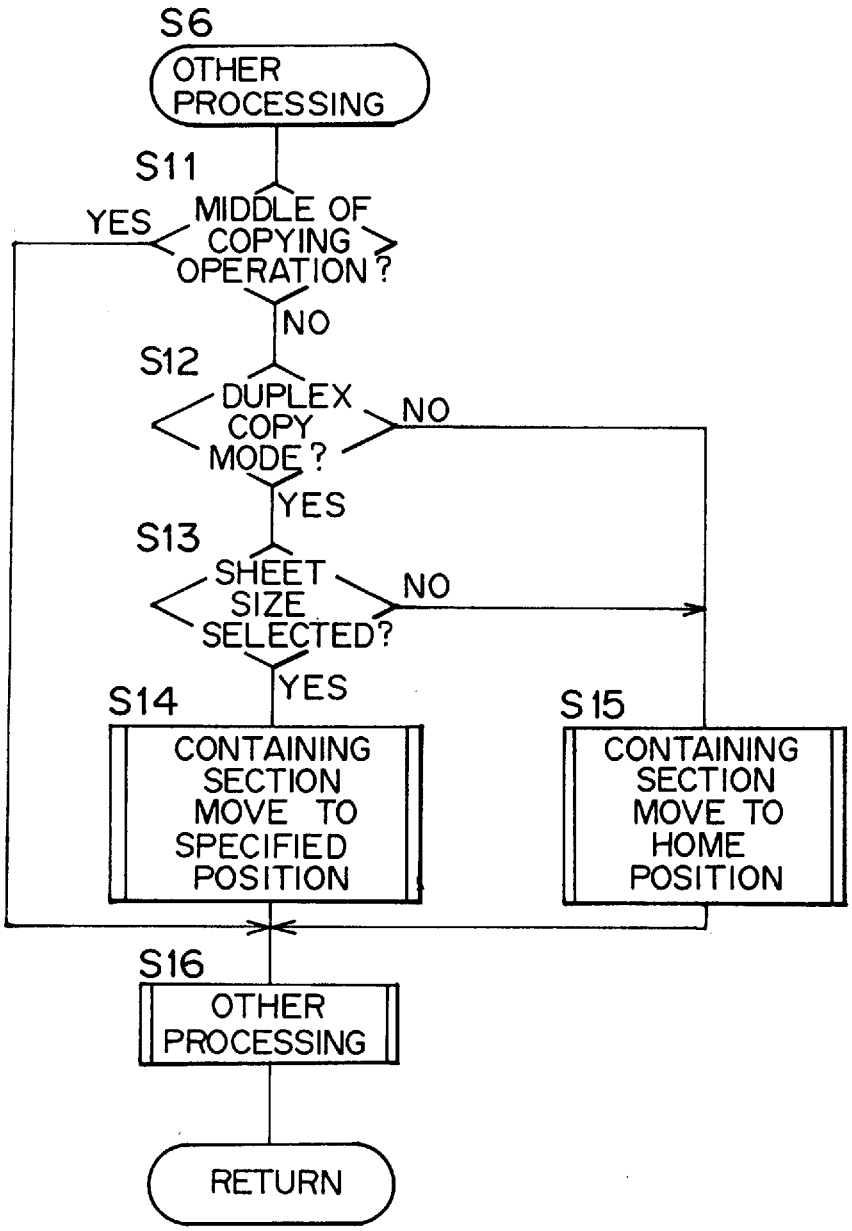
FIG. 17 is a flowchart which shows a subroutine of other processing.

FIG. 17 shows a subroutine of other processing which is carried out at step S6 of the main routine.

First, at step S11, whether it is in the middle of the copying operation or not is judged. If during the copying operation, the operation goes to step S16. If it is not during the copying operation, whether the duplex copy mode is selected or not is judged at step S12 and whether a sheet size is selected or not is judged at step S13. If it is judged "NO" both in steps S12 and S13, the containing section 130 is moved to the home position (refer to FIG. 10) at step S15. The home position of the containing section 130 is a position wherein the second containing roller 133 is set corresponding to a length of A4 lateral sheet.

If the duplex copy mode is selected and the sheet size is determined ("YES" at steps S12 and S13), the containing section 130 is moved to a specified position corresponding to the sheet size at step S14.

Detection of the copying operation and a trouble related to the copying operation such as a sheet jam, temperature control of the fixing device 14 and so on are controlled at step S16.

Figure 18:
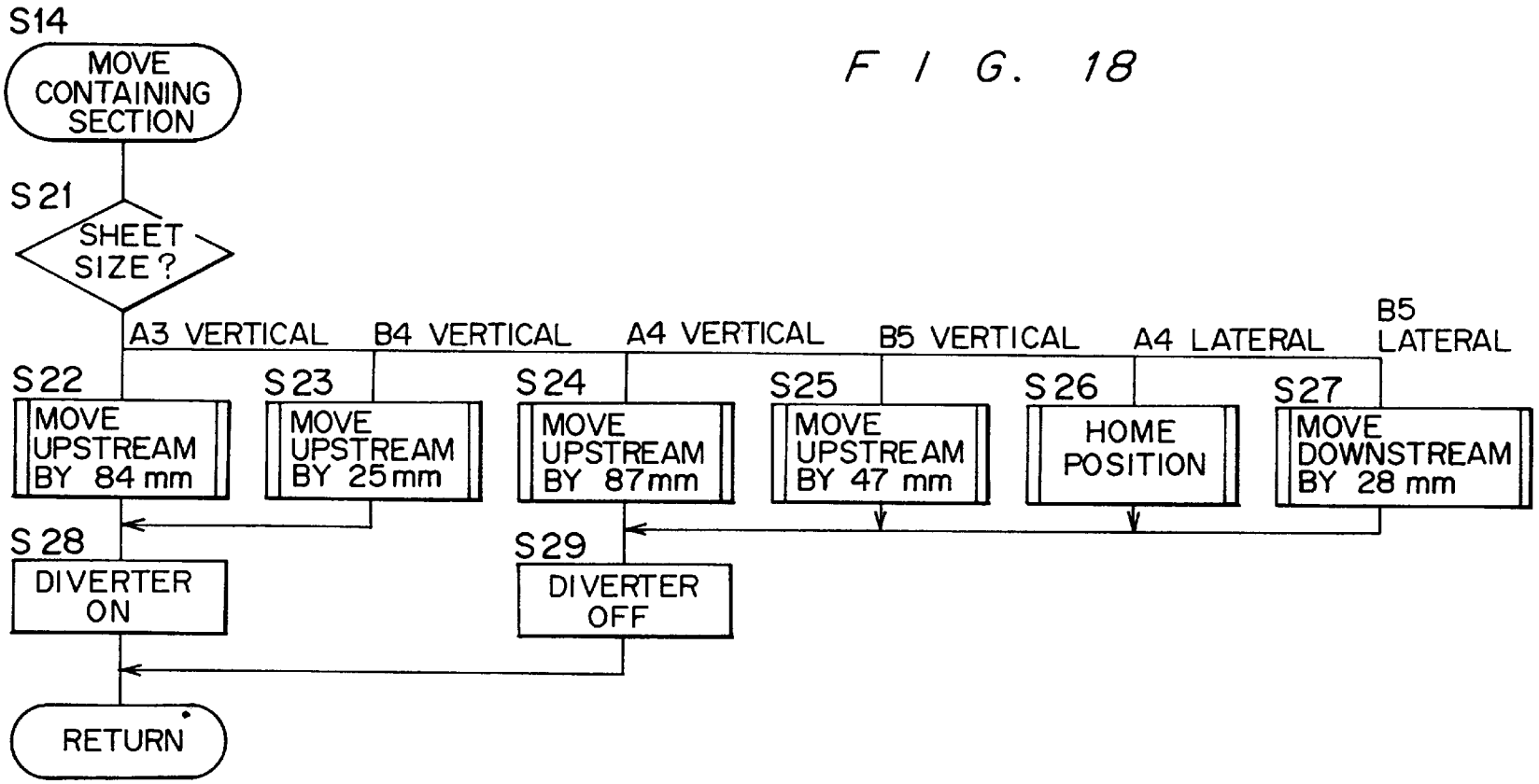
FIG. 18 is a flowchart which shows a subroutine of moving the containing section.

FIG. 18 shows a subroutine of the movement of the containing section 130 which is carried out at step S14.

First, after the sheet size is judged at step S21, the containing section 130 is moved to a position corresponding to the sheet size. The home position of the containing section 130 is the position when the sheet size is A4 lateral (refer to FIGS. 9*a* and 10). Moving amounts at steps S22 through S25 and S27 are calculated from the home position. A sheet of A3 vertical or B4 vertical is sent into the intermediate tray 110 from the first containing roller 131. Thus, the sheet is guided downward from the first containing roller 131 by turning on the diverter 132 at step S28. A sheet of A4 or smaller size is sent into the intermediate tray 110 from the second containing roller 133. Thus, the sheet is guided from the roller 131 to the roller 133 by turning off the diverter 132 at step S29.

Figure 19:
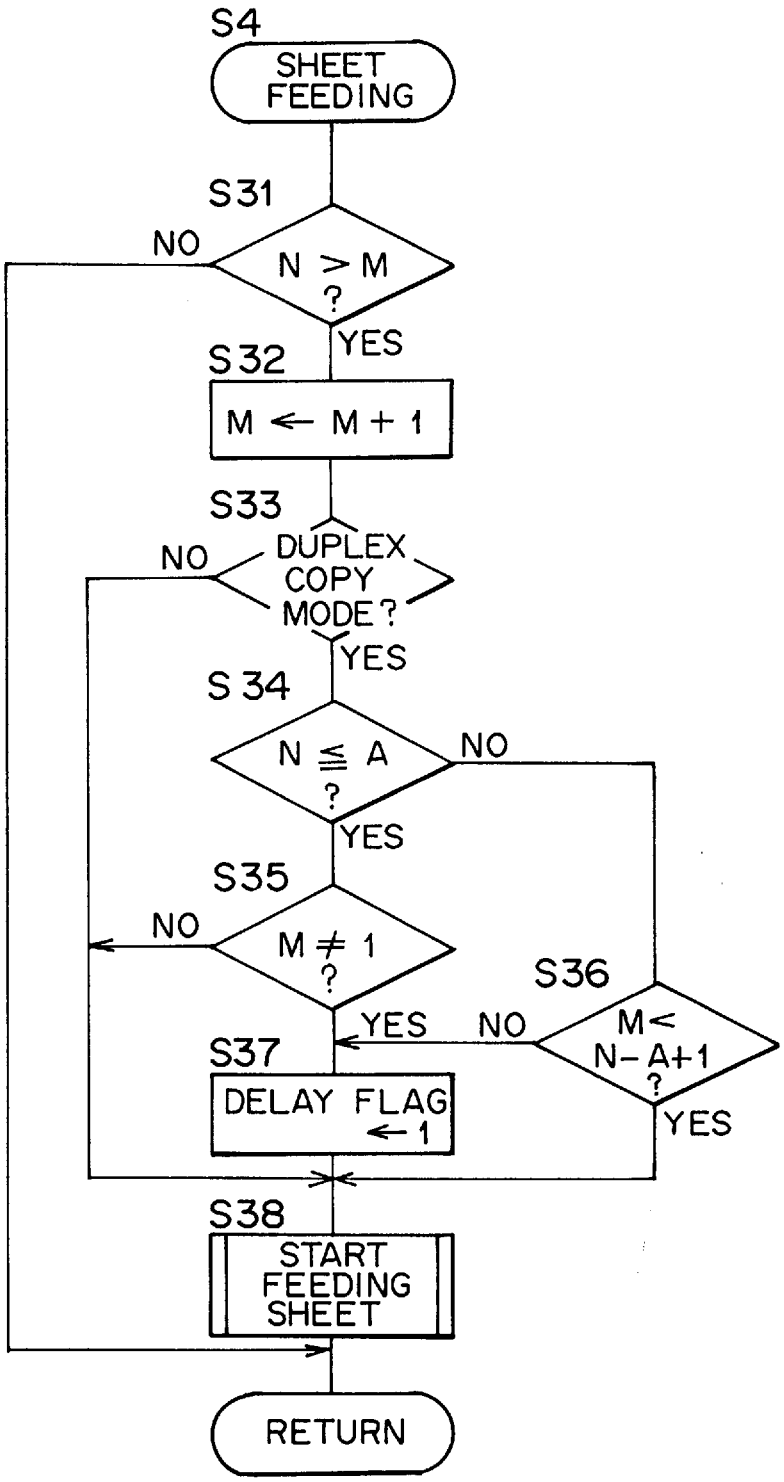
FIG. 19 is a flowchart which shows a subroutine of feeding processing.

FIG. 19 shows a subroutine of the sheet feeding which is carried out at step S4 of the main routine.

First, an inputted number of copies N and the order of a sheet M which is next fed from the feeding section 30 are compared at step S31. The order of the sheet M is detected by a counter, and the initial value of the counter is "0". When N>M, the processing from steps S32 through S38 are carried out, and when M reaches N, the subroutine is finished immediately. When N>M, 1 is added to the counter value M at step S32. Then, whether the duplex copy mode is selected or not is judged at step S33. If the duplex copy mode is not selected, the feeding is started at step S38. If the duplex copy mode is selected, the number of copies N and a specified value A are compared. The specified value A corresponds to a number of sheets which are refed in the priority refeeding. For example, if the sheet size is A4 lateral and the copying magnification is one, the specified value is "4", and when the sheet size is A4 vertical and the copying magnification is one, the specified value is "3".

If it is judged N≦A at step S34, all sheets are to be refed in the priority refeeding. Whether the counter value M is "1" or not is judged at step S35. When the counter value M is "1", the sheets are fed at normal timing at step S38. When the counter value M is not "1", a delay flag is set to "1" at step S37, and the delayed feeding is carried out at step S38. When it is judged N>A at step S34, sheets are divided into two groups, a number (N−A) of sheets which are stocked in the intermediate tray 110 and a number A of sheets which are not stocked and refed in the priority refeeding. The delayed feeding is started with the sheet of the order (N−A+1). Thus, the counter value M is compared with the value (N−A+1), and sheets are fed at normal timing at step S38 until the counter value M reaches (N−A+1). When the counter value M reaches (N−A+1), the delay flag is set to "1" at step S37 and the delayed feeding is carried out at step S38.

Figure 20:
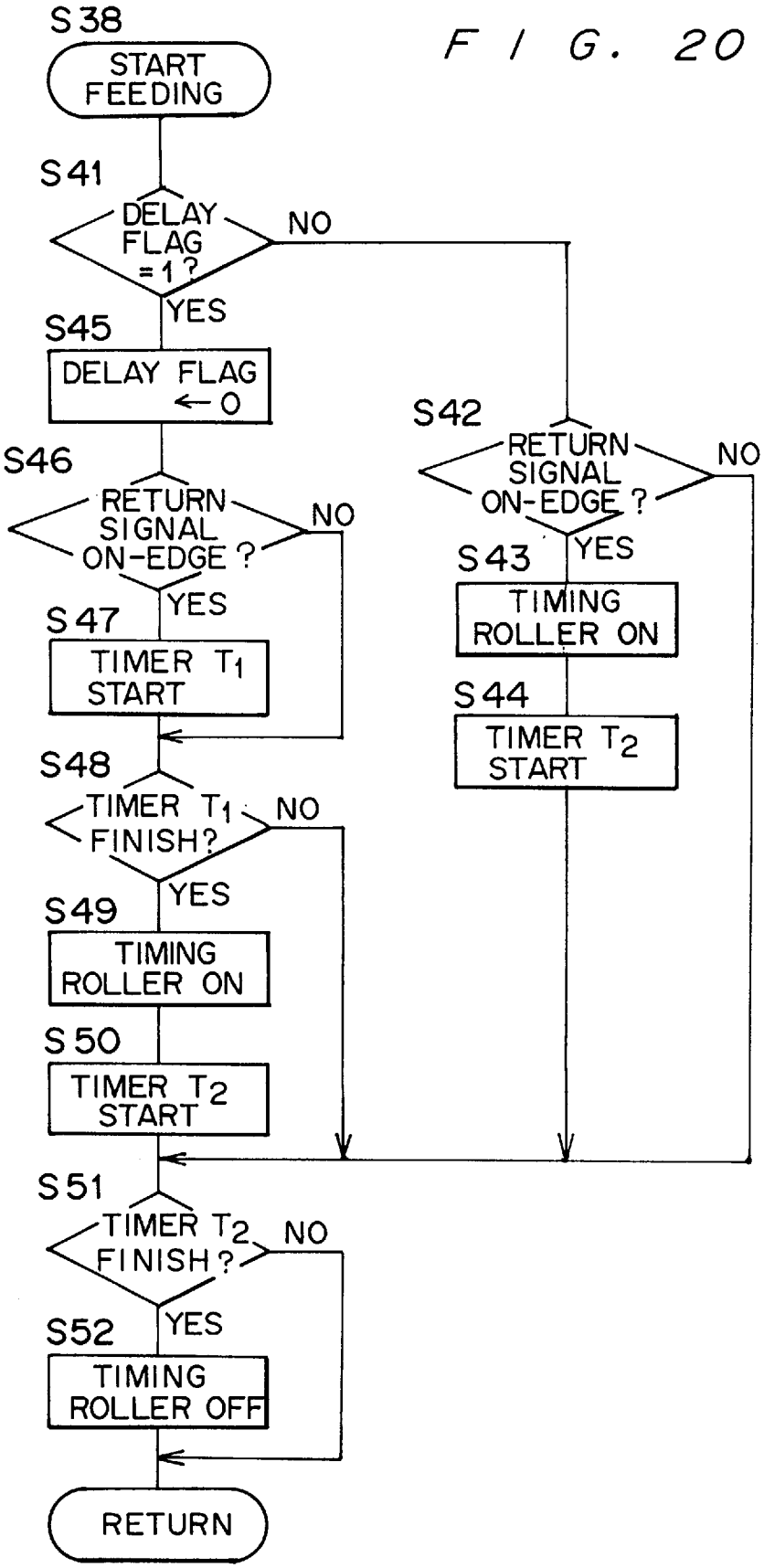
FIG. 20 is a flowchart which shows a subroutine of feeding start.

FIG. 20 shows a subroutine of feeding start which is carried out at step S38.

First, the delay flag is checked at step S41. When the delay flag is reset to "0", the feeding is carried out at the normal timing. The normal timing means the time when a return signal which shows the end of the exposure scanning of the optical system 20 becomes on-edge. The on-edge of the return signal is checked at step S42, and the timing rollers 12 are turned on at step S43. Thereby, the sheet is sent to the transfer position. Then, a timer T2 is started at step S44 and the operation goes to step S51.

When the delay flag is set to "1", the delay flag is reset to "0" at step S45, and after the return signal becomes on-edge at step S46, a timer T1 is started at step S47. Then, when it is judged that the count of the timer T1 is finished, the timing rollers 12 are turned on at step S49. Thus, the timing of sending a sheet to the transfer position is delayed by the counted time of the timer T1 to widen an interval between the sheet and the previous sheet. Then, the timer T2 is started at step S50 and the operation goes to step S51.

When it is judged that the counting of the timer T2 is finished at step S51, the timing roller 12 is turned off at step S52 and this subroutine is finished.

Also, since the feeding operation from each of the cassettes 31 through 34 in the feeding section 30 is well-known, the description of this operation is omitted.

Figure 21A:
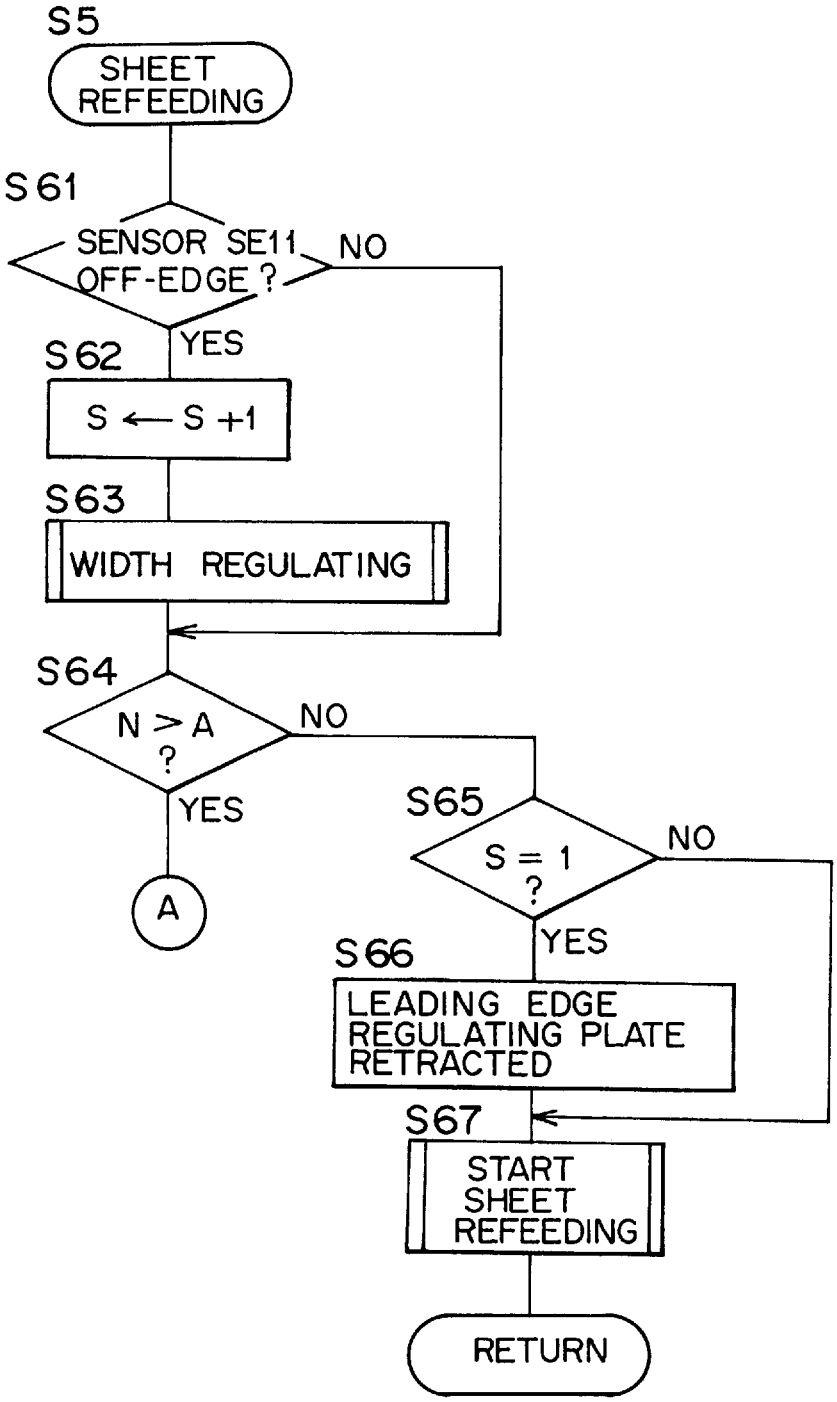
FIGS. 21*a* and 21*b* are flowcharts which shows a subroutine of refeeding processing.
Figure 21B:
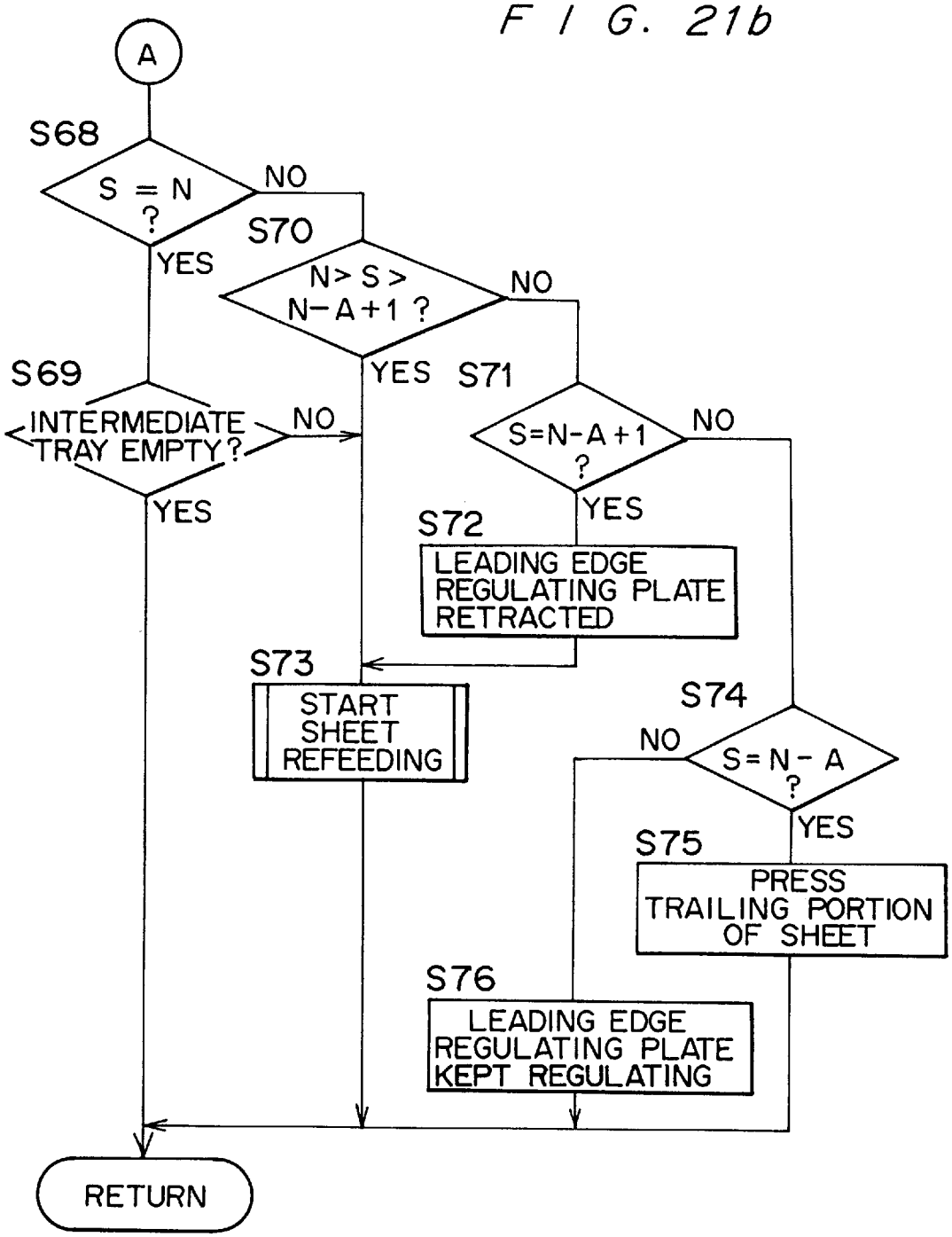

FIGS. 21*a* and 21*b* show a subroutine of the sheet refeeding which is carried out at step S5 of the main routine.

First, when it is judged that the sensor SE11 which is provided at the containing section 130 is off-edge at step S61, that is, when the trailing edge of a sheet passes through the first containing roller 131, "1" is added to the value S of the containing sheet counter at step S62. Then, the width regulation plates 171 and 172 are started operating at step S63, and the sheet which are contained in the intermediate tray 110 is regulated in the width direction.

Next, the inputted number of copies N and the specified value A are compared at step S64. If the number N is smaller than the specified value A, all sheets are refed in the priority refeeding. In this case, when it is confirmed at step S65 that the counter value S is "1", the leading edge regulating plate 115 is retracted. Then, the sheets are refed in the priority refeeding at step S67.

On the other hand, if the inputted number of copies N is larger than the specified value A, in order to divide the sheets into a group to be stocked in the intermediate tray 110 and a group to be refed in the priority refeeding, the values N, (N−A+1) and (N−A) are compared with the counter value S at steps S68, S70, S71 and S74 respectively. Until the counter value S reaches (N−A) ("NO" at step S74), the leading edge of the sheets are kept regulated by the leading edge regulating plate 115 at step S76. Sheets which are sent into the intermediate tray 110 in this period are stocked therein. When the counter value S reaches (N−A) ("YES" at step S74), the solenoid 163 is turned on, and the trailing portion of the number (N−A) of sheets which are stocked in the intermediate tray 110 are pressed by the pressing member 160. When the next sheet is contained, that is, when the counter value S reaches (N−A+1) ("YES" at step S71), the leading edge regulating plate 115 is retracted at step S72, and the sheet is refed in the priority refeeding. While the counter value S is in between (N−A+1) and N ("YES" at step S70), sheets which are sent into the intermediate tray 110 are refed immediately in the priority refeeding at step S73. When the last sheet is sent into the intermediate tray 110 ("YES" at step S68), after confirming that there is a sheet in the intermediate tray 110 by the sensor SE12 at step S69, the last sheet is refed in the priority refeeding at step S73.

After that, the number (N−A) of sheets which are stocked in the intermediate tray 110 are refed successively. Since this refeeding is an ordinary operation, the description of the control procedure of this refeeding is omitted. After the last sheet in the intermediate tray 110 is refed, the pressing member 160 comes back to the home position automatically.

[Other Embodiments]

The movement of the containing section 130 according to the sheet size can be carried out manually by an operator. In this case, a handle for moving the containing section 130 needs to be provided, and at the same time, a device for stopping the containing section 130 in a position corresponding to the sheet size needs to be provided.

A belt member can be used instead of the containing rollers 131 and 133. Also, although the priority refeeding in the duplex copy mode is described in the above embodiment, the priority refeeding can be also carried out in the same way as the composite copy mode.

Also, the refeeding can be carried out in a method that sheets which are contained in the intermediate tray 110 are refed from the most bottom sheet.

Although the present invention has been described in connection with the preferred embodiments above, it is to be noted that various changes and modifications are apparent to a person skilled in the art. Such changes and modifications are to be understood as being within the scope of the present invention.

What is claimed is:

1. An image forming apparatus capable of forming images on a plurality of sizes of sheets, comprising:

a recording section for forming an image on a sheet;

an intermediate tray which receives and contains sheets, each of the sheets having on a first side an image formed by the recording section;

a pickup roller for feeding the sheets which are contained in the intermediate tray one by one; and a containing section for transporting the sheets to the intermediate tray, the containing section being movable along the intermediate tray to convert the containing section for use with a sheet of a first predetermined size to a sheet of a second predetermined size, said containing section remaining fixed relative the intermediate tray for containing sheets of the same size, said containing section further having a rotary member which sends the sheets into the intermediate tray.

2. An image forming apparatus as claimed in claim 1, further comprising:

a judging device for judging a sheet size; and a driver for moving the containing section to a specified position corresponding to the sheet size which is judged by the judging device.

3. An image forming apparatus as claimed in claim 1, wherein the containing section has a first roller for receiving a sheet and a second roller for sending the sheet to the intermediate tray, an interval existing between the first and second rollers, the interval between the first roller and the second roller being shorter than a length of a smallest size of sheet.

4. An image forming apparatus as claimed in claim 3, further comprising:

a sheet transporting roller provided adjacent to an inlet of the containing section, wherein an interval between the first roller and the sheet transporting roller is, when the containing section is moved to a position to send a smallest size sheet to the intermediate tray, shorter than the length of the smallest size of sheet.

5. An image forming apparatus as claimed in claim 3 wherein the interval existing between the first and second rollers is a fixed distance.

6. An image forming apparatus comprising:

a recording section for forming an image on a sheet;

an intermediate tray which receives and contains sheets, each of the sheets having on a first side an image formed by the recording section;

a pickup roller for feeding the sheets which are contained in the intermediate tray one by one;

a containing section for transporting the sheets to the intermediate tray, the containing section being movable along the intermediate tray and having a rotary member which sends the sheets into the intermediate tray; and a flexible guiding member, one end of the guiding member being connected with the containing section and extending upstream with respect to a sheet transporting direction; and a member for providing a tension to the guiding member, the member being connected with the other end of the guiding member.

7. An image forming apparatus as claimed in claim 6, further comprising:

a stepping motor for moving the containing section; and a controller for driving the stepping motor, the controller driving the stepping motor at a first rotation rate when the containing section is moved upstream with respect to the sheet transporting direction and at a second rotation rate which is different from the first rotation rate when the containing section is moved downstream.

8. An image forming apparatus as claimed in claim 6, further comprising:

a first motor for driving the rotary member of the containing section;

a belt for transmitting the rotating power of the first motor to the rotary member, the belt being fitted around the first motor and the rotary member;

a second motor for moving the containing section in a first direction and a second direction opposite to the first direction; and a controller for driving both the first motor and the second motor when the containing section is moved in the first direction and driving only the second motor, when the containing section is moved in the second direction.

9. An image forming apparatus for forming an image on a sheet, the apparatus capable of use with a plurality of sheet sizes, comprising:

a recording section for forming an image on a sheet;

an intermediate tray for receiving and containing sheets, each of the sheets having on a first side an image formed by the recording section;

a pickup roller for feeding the sheets which are contained in the intermediate tray one by one;

a containing section for feeding the sheets to the intermediate tray, the containing section being stationary at a first position relative the intermediate tray to feed a first size of sheet and being movable along the intermediate tray to a second position relative the intermediate tray to feed a second size of sheet, said containing section further having a lower driving roller and an upper driven roller for sending the sheets into the intermediate tray;

an upper guiding member for guiding an upper side of the sheet which is being transported from the containing section to the intermediate tray; and a holding member for holding the upper driven roller rotatable, the holding member being movable in a sheet transporting direction on the upper guiding member.

10. An image forming apparatus as claimed in claim 9, wherein said upper guiding member is pivotally provided on the body of the image forming apparatus so as to open a sheet transporting path.

11. An image forming apparatus comprising:

a recording section for forming an image on a sheet;

an intermediate tray which receives and contains sheets, each of the sheets having on a first side an image formed by the recording section;

a pick-up roller for feeding the sheets which are contained in the intermediate tray one by one; and a pair of rollers in which the rollers are separated a predetermined fixed distance from each other and which sends the sheets into the intermediate tray and is movable along the intermediate tray.

12. An image forming apparatus as claimed in claim 11, wherein said pair of rollers is accommodated in a frame movably supported on a guide member extending in the sheet transporting direction.

13. An image forming apparatus as claimed in claim 12, further comprising a guide means for guiding sheets to the frame, said guide means having first and second ends, the first end being connected on the frame and the second end connected on the body of the image forming apparatus and being flexible in response to the movement of the frame.

14. An image forming apparatus as claimed in claim 11 wherein said pair of rollers is fixed relative the intermediate tray for a specific size of sheet.

15. An image forming apparatus comprising:

a recording section for forming an image on a sheet;

an intermediate tray for receiving and piling/containing sheets, each of the sheets having on a first side an image formed by the recording section;

a pick-up roller for feeding the sheets which are piled/contained in the intermediate tray from a most top sheet successively one by one;

a controller for, after a specified number of sheets are piled/contained in the intermediate tray, controlling the pick-up roller to feed any sheet having an image formed on the first side thereof by said recording section immediately after the specified number of sheets prior to feeding the specified number of sheets piled/contained in the intermediate tray; and a pressing member which, immediately after the specified number of sheets are piled/contained in the intermediate tray, starts pressing a trailing portion of the specified number of sheets.

16. An image forming apparatus as claimed in claim 15, wherein the pressing member is provided within an installing width of the pick-up roller.

17. An image forming apparatus as claimed in claim 15, further comprising:

a containing section for feeding sheets, each of which has on a first side an image formed by the recording section to the intermediate tray, the containing section being movably provided on the body of the image forming apparatus and holding said pressing member thereon;

a judging device for judging a sheet size; and a driver for moving the containing section to a specified position corresponding to the sheet size which is judged by the judging device.

18. An image forming apparatus as claimed in claim 17, wherein the containing section has a roller for sending the sheets into the intermediate tray, the pressing member being provided at a shaft of the roller.

19. An image forming apparatus as claimed in claim 18, further comprising a prohibiting member for prohibiting the pressing member from starting pressing the sheets until the specified number of sheets are piled/contained in the intermediate tray.

20. An image forming apparatus as claimed in claim 18, wherein the pressing member is fitted to the shaft of the roller and rotated by a friction generated between the pressing member and the shaft, and when a load more than a specified value is applied, the pressing member slips on the shaft of the roller.

21. A sheet feeding method comprising the steps of:

feeding a specified number of sheets at intervals of a first time period to an image recording section where an image is formed on a first side of each sheet and piling/containing the sheets in an intermediate tray successively;

feeding one or more sheets after the specified number of sheets to the image recording section at intervals of a second time period which is a little longer than the first time period and feeding the sheets to the intermediate tray;

refeeding the sheets fed at intervals of the second time period to the image recording section immediately after the specified number of sheets were piled/contained in the intermediate tray; and refeeding the sheets which are piled/contained in the intermediate tray to the image recording section successively after all of the sheets fed at intervals of the second time period were refed.

22. A sheet feeding method as claimed in claim 21, wherein, immediately after the specified number of sheets were piled/contained in the intermediate tray, a trailing portion of the sheets is pressed by a pressing member.

23. A sheet feeding method for feeding a plurality of sheets to an image recording section, said sheet feeding method comprising the steps of:

feeding a plurality of sheets to the image recording section one by one to form an image on one side of the sheets;

stacking some of the sheets transported from the image recording section in an intermediate tray;

transporting other sheets transported from the image recording section to the image recording section;

feeding said some of the sheets which are stacked in the intermediate tray to the image recording section successively after said other of the sheets were transported.

* * * * *

UNITED STATES PATENT AND TRADEMARK OFFICE

CERTIFICATE OF CORRECTION

PATENT NO. : 5,857,137

DATED : January 5, 1999

INVENTOR(S) : Sakata, et al

It is certified that error appears in the above-indentified patent and that said Letters Patent is hereby corrected as shown below:

In column 17, line 46, claim 15, delete "most top" and insert --top most--.

In column 18, line 48, claim 22, before "sheets", insert --specified number of--.

Signed and Sealed this

Second Day of November, 1999

*Attest:*

*Attesting Officer*

Q. TODD DICKINSON

*Acting Commissioner of Patents and Trademarks*